US012715726B1

(12) United States Patent
Sands et al.

(10) Patent No.: US 12,715,726 B1
(45) Date of Patent: Aug. 25, 2026

(54) COLLATING SYSTEM WITH FRICTION RESISTANT CHANNELS

(71) Applicant: Superior Product Handling Solutions, Inc., Brooklyn Park, MN (US)

(72) Inventors: Steven G. Sands, Plymouth, MN (US); Joseph R. Lacher, Zimmerman, MN (US)

(73) Assignee: Superior Product Handling Solutions, Inc., Brooklyn Park, MN (US)

( * ) Notice: Subject to any disclaimer, the term of this patent is extended or adjusted under 35 U.S.C. 154(b) by 198 days.

(21) Appl. No.: 18/597,302

(22) Filed: Mar. 6, 2024

Related U.S. Application Data

(60) Provisional application No. 63/489,296, filed on Mar. 9, 2023.

(51) Int. Cl.
*B65H 39/11* (2006.01)

(52) U.S. Cl.
CPC ..... *B65H 39/11* (2013.01); *B65H 2404/5311* (2013.01); *B65H 2408/111* (2013.01)

(58) Field of Classification Search
CPC .. B65H 31/20; B65H 39/11; B65H 2404/531; B65H 2404/5311; B65H 2404/742; B65H 2301/3611; B65H 2301/3613; B65H 2301/362; B65H 2301/363; B65H 2408/111; B65H 2408/114
See application file for complete search history.

(56) References Cited

U.S. PATENT DOCUMENTS

| | | | | |
|---|---|---|---|---|
| 3,887,176 | A | 6/1975 | Paulus et al. | |
| 5,499,806 | A | 3/1996 | Bourg | |
| 5,503,380 | A * | 4/1996 | Hidding | B07C 1/00 382/218 |
| 7,059,595 | B2 * | 6/2006 | DaCunha | B65H 9/108 271/226 |
| 7,686,289 | B2 | 3/2010 | Ono et al. | |
| 10,183,821 | B2 * | 1/2019 | Oshiro | B65H 1/266 |

FOREIGN PATENT DOCUMENTS

| | | |
|---|---|---|
| JP | 4101332 B2 | 6/2008 |
| JP | 2009256063 | 11/2009 |
| JP | 2009269690 | 11/2009 |

(Continued)

*Primary Examiner* — Leslie A Nicholson, III
(74) *Attorney, Agent, or Firm* — Jonas R. Mellang; KELLY, HOLT & CHRISTENSON PLLC

(57) ABSTRACT

A vertical collating system includes a plurality of channels, each channel, of the plurality of channels, having one or more channel walls. The system includes a plurality of feeders configured to hold a plurality of objects, each feeder, of the plurality of feeders, corresponding to a respective channel, of the plurality of channels, and configured to dispense one or more objects of the plurality of objects into the respective channel. The respective channel has a material that engages the object as the object is dispensed through the respective channel, and a first coefficient of friction between the object and the material is different than a second coefficient of the friction between the object and the one or more channel walls of the respective channel. The system includes an accumulation area configured to receive each dispensed object from each respective channel to form a set of collated objects.

12 Claims, 18 Drawing Sheets

(56) References Cited

FOREIGN PATENT DOCUMENTS

| | | | |
|---|---|---|---|
| JP | 2010163246 | | 7/2010 |
| JP | 2012254883 | | 12/2012 |
| JP | 5187888 | | 4/2013 |
| JP | 5422808 | B2 | 2/2014 |
| JP | 2014172755 | | 9/2014 |
| JP | 6887605 | | 6/2021 |

* cited by examiner

COLLATING SYSTEM WITH FRICTION RESISTANT CHANNELS

CROSS-REFERENCE TO RELATED APPLICATION

The present application is based on and claims the benefit of U.S. provisional patent application Ser. No. 63/489,296, filed Mar. 9, 2023, the contents of which are hereby incorporated by reference in their entirety.

BACKGROUND

Collators are employed in a wide variety of applications. Some examples include, but are not limited to, industrial and commercial applications that manufacture and/or process literature or other items. Collators operate by combining, merging, or otherwise organizing literature or other items into a desired order. Collators can organize literature at an efficient rate, thereby reducing processing time at the environment in which they are employed.

The discussion above is merely provided for general background information and is not intended to be used as an aid in determining the scope of the claimed subject matter. The claimed subject matter is not limited to implementations that solve any or all disadvantages noted in the background.

SUMMARY

A vertical collating system includes a plurality of channels, each channel, of the plurality of channels, having one or more channel walls. The system includes a plurality of feeders configured to hold a plurality of objects, each feeder, of the plurality of feeders, corresponding to a respective channel, of the plurality of channels, and configured to dispense one or more objects of the plurality of objects into the respective channel. The respective channel has a material that engages the object as the object is dispensed through the respective channel, and a first coefficient of friction between the object and the material is different than a second coefficient of the friction between the object and the one or more channel walls of the respective channel. The system includes an accumulation area configured to receive each dispensed object from each respective channel to form a set of collated objects.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Figure 1:
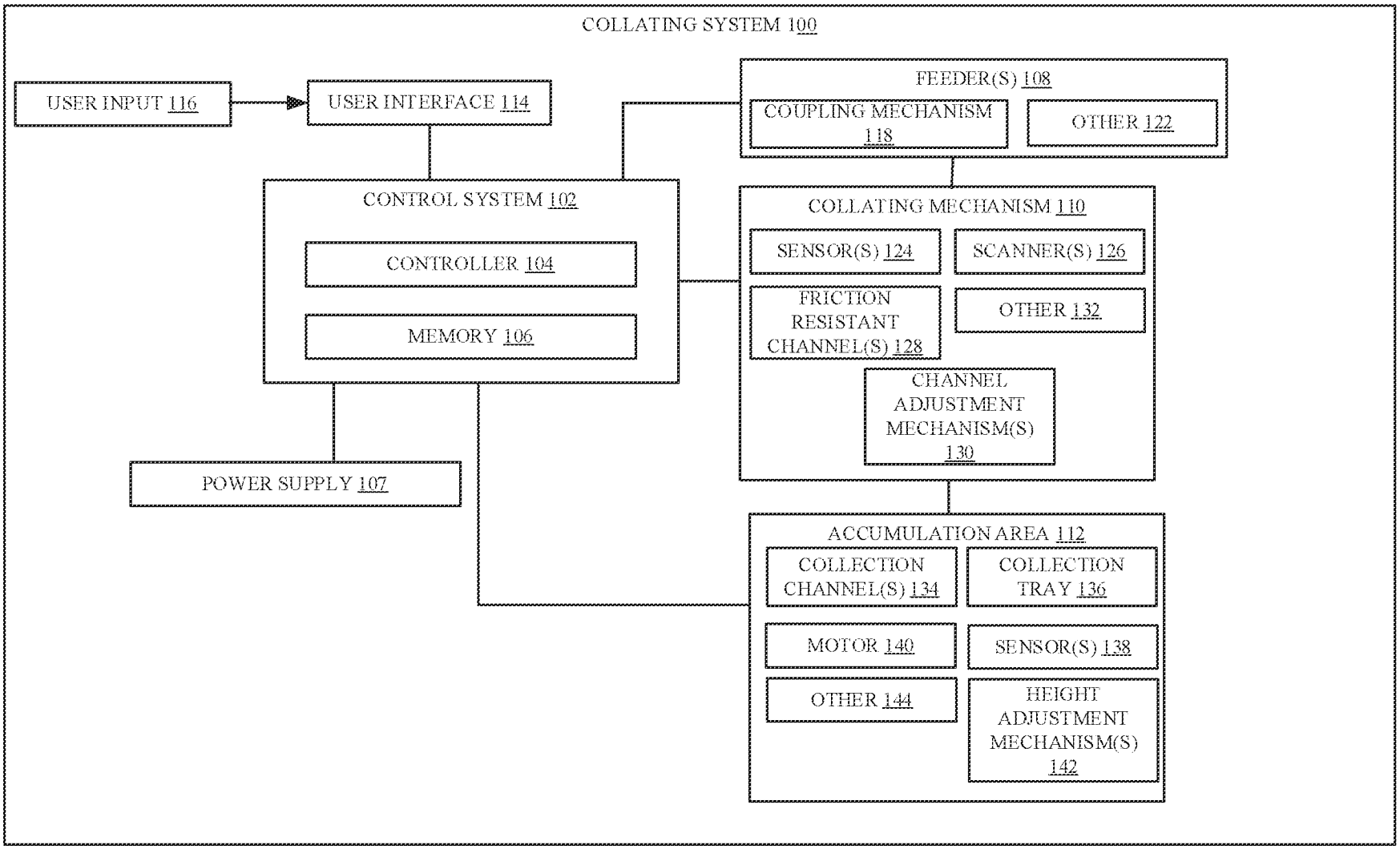
FIG. 1 is a block diagram showing one example collating system.

FIG. 1 is a block diagram showing one example of a collating system 100. Collating system 100 illustratively includes a control system 102 generally configured to control the one or more components of collating system 100. Control system 102 illustratively includes a controller 104 and a memory 106. Controller 104 is powered by a power supply 107 provides computation, software, data access, storage, and control services to the various components of collating system 100. Controller 104 can deliver the services and/or control operations in a variety of ways, such as by internal wiring, wireless communication, or any other form of signal transmission. Software or other components of control system 102, as well as the corresponding data, can be stored in memory 106. For example, executable instruction representing control operations, pertaining to the methods at which the components of collating system 100 are controlled, can be stored in memory 106 and executed by one or more computer processors. Additionally, memory 106 can store other items as well, such as user presets, system history, etc. As shown, collating system 100 also includes one or more feeders 108, collating mechanism 110, accumulation area 112, and user interface 114 electronically coupled to control system 102.

Power supply 107 can be any of a variety of power sources. For example, power supply 107 can include a one hundred and twenty volt alternating current (AC) power source. Alternatively, or in addition, power supply 107 can include a battery pack. These, of course, are for sake of example only.

Prior to starting the collating operation by collating system 100, user interface 114 receives a user input 116 and can generate an output, such as on a visual display device. The user input can include, for example, an indication to start and/or proceed with the collating operation. The user input can also include other input parameters as well, such as an indication of the number of items and/or copies to be collated, operation time, etc. The user interface can be, in one example, displayed on a display screen coupled to collating system 100, as described below with respect to FIGS. 4A-5E. However, it is expressly contemplated that the user interface can be displayed on a different screen as well (e.g., a mobile device). Upon actuation of user interface 114 by user input 116, control system 102 can communicate with the one or more feeder(s) 108, collating mechanism 110, and accumulation area 112 to control operation of collating system 100 based on user input 116.

As noted above, collating system 100 further includes one or more feeder(s) 108. The number of feeders 108 being implemented in collating system 100 can be chosen relative to the number of objects to be collated. In the examples described below with respect to FIG. 4A-4F, four feeders are utilized. However, in other examples, more than or less than four feeders 108 can be used.

Feeder(s) 108 are configured to receive one or more objects to be collated. Feeder(s) 108 can also be sized relative to the size of the objects to be collated. As further described below, feeder(s) 108 are self-contained modules, each having the necessary operational hardware disposed therein. For example, each feeder 108 has a friction belt, bin, one or more rollers, and electrical components as a compact, separately removably unit. Each unit is communicatively coupled to, and powered by, control system 102 through a wired, plug-in connection of any suitable type.

Additionally, feeder(s) 108 operate in a bottom-to-top configuration. That is, the friction belt of each respective feeder 108 draws an object from the bottom of an object stack for collation by collating mechanism 110. In one example operation, a respective object is fed from each of the four feeder(s) 108 to collating mechanism 110, and collation of the four objects fed from each feeder 108 occurs.

As shown, feeder(s) 108 illustratively include coupling mechanism 118. Coupling mechanism 118 is configured to removably couple each respective feeder 108 to collating mechanism 110. Examples are discussed below with respect to FIGS. 4A-4F. Briefly, however, coupling mechanism 118 can include one or more screws that secure feeder(s) 108 to collating mechanism 110. In another example, coupling mechanism 118 can include one or more user actuatable knobs that can secure feeder(s) 108 to collating mechanism 110. In operation, coupling mechanism 118 allows feeder(s) 108 to be secured to and detachable from collating mechanism 110. In this way, each utilized feeder 108 can be easily removed from collating mechanism 110. For example, if a utilized feeder 108 undergoes a mechanical error, the feeder unit may need to be replaced. Because feeder(s) 108 are self-contained modules, the feeder unit can be easily removed and replaced by coupling mechanism 118 without having to further inhibit or otherwise deactivate operation of collating system 100. Further, additional feeders 108 can be retrofitted by coupling mechanism 118 without having to halt operation of collating system 100. For example, a user operating collating system 100 with two feeders 108 can add additional feeders 108 via coupling mechanism 118, if desired. Additionally, it is expressly contemplated that feeder(s) 108 can include other items as well, as indicated by block 122.

Collating system 100 illustratively includes collating mechanism 110. As shown in FIG. 1, collating mechanism 110 includes one or more sensors 124 coupled to the one or more feeders 108. In operation, sensor(s) 124 are configured to detect the presence of objects within the one or more feeders 108. Collating mechanism 110 can also optionally include one or more scanners 126, which are configured to scan or otherwise read the objects disposed in each respective feeder. Scanner(s) 126 can read, for example, a barcode displayed on the one or more objects. In another example, scanner(s) 126 can scan a label displayed on the one or more objects and use collected label information as the basis for collating.

Collating mechanism 110 further includes one or more friction resistant channels 128. The number of friction resistant channels utilized is relative to the number of feeders 108 being used. In one example, four friction resistant channels 128 are utilized for four feeders, wherein one friction resistant channel 128 is coupled to a respective feeder 108. However, it is expressly contemplated that fewer or additional feeders 108 can be utilized as well. As discussed in more detail below, friction resistant channel(s) 128 are configured such that collated objects can transfer to the accumulation area with minimum frictional resistance for retrieval. In this way, collated objects can travel through channel(s) 128 by gravity with little/no additional force. In one example, friction resistant channel(s) 128 are passive, gravity-drop mechanisms that do not utilize active elements, such as driver rollers, to propel items through the channel(s) 128. For instance, each channel 128 includes a material having a low relative coefficient of friction with the objects that minimizes frictional resistance of channel(s) 128 against objects traveling downward within the channel.

Collating mechanism 110 further includes one or more channel adjustment mechanism(s) 130. As further discussed below in FIGS. 4A-4F, each channel adjustment mechanism 130 is coupled to a respective channel of the one or more channel(s) 128. Channel adjustment mechanism(s) 130 can be, in one example, disposed adjacent to a respective channel of the one or more channel(s) 128. Channel adjustment mechanism(s) 130 are configured to adjust the channel width of the respective channel 128 upon actuation. For example, upon actuation, channel adjustment mechanism(s) 130 can increase or decrease the width of the respective channel 128 relative to the objects traveling therethrough. Channel adjustment mechanism(s) 130 can be, in one example, one or more adjustment knobs that adjust channel width of the respective channel 128 upon actuation by an operator. For example, two adjustment knobs can be utilized, wherein each adjustment knob is configured to adjust the width of the respective channel 128 by adjusting a respective plane of channel 128. In this example, one plane of channel 128 can be adjusted by the first adjustment knob, and the other plane of channel 128 can be adjusted by the second adjustment knob. However, in another example, only one adjustment knob can be utilized to adjust the width of channel 128. In operation, an operator can rotate the one or more adjustment knobs in a first direction to increase the width of the respective channel 128 and rotate the adjustment knobs in a second direction to decrease the width of the respective channel 128. Additionally, in other examples, channel adjustment mechanism 130 can be an automatic adjustment mechanism, in which channel adjustment mechanism 130 automatically adjusts the width of the respective channel 128 relative to the size of sensed objects traveling through channel 128.

As the width of channel 128 changes relative to actuation of channel adjustment mechanism 130, the pressure of the objects acting against the interior of channel 128 also changes. For example, when channel adjustment mechanism 130 is actuated to increase the width of channel 128, the pressure of the objects acting against the interior surface of channel 128 decreases. Similarly, when channel adjustment mechanism 130 is actuated to decrease the width of channel 128, the pressure of the objects acting against the interior surface of channel 128 increases. Therefore, the frictional force acting against the objects as the objects travel through channel 128 is adjustable by changing the width of channel 128 using channel adjustment mechanism 130.

For example, an operator can adjust the width of channel 128 relative to the size of the object to control the speed at which the object travels through channel 128. In another example, an operator can adjust the width of channel 128 relative to the type of material the object consists of. In these examples, channel adjustment mechanism 130 can adjust the width relative to the characteristics of the object such that frictional force against the object is minimized as the object travels through channel 128. Additionally, it is expressly contemplated that collating mechanism 110 can also include other items as well, as indicated by block 132.

Collating system 100 illustratively includes accumulation area 112, which is coupled to friction resistant channel(s) 128 and configured to collect the collated objects. As shown, accumulation area 112 includes one or more collection channels 134, described in further detail below with respect to FIG. 4D. Each collection channel 134 is configured to receive the collated objects from a respective feeder 108 via a respective channel 128. After the collation process occurs, an operator can collect the collated objects at collection channels 134, allowing for the next object in each feeder 108 to be fed into collating mechanism 110 and collated. In one example, accumulation area 112 can optionally include collection tray 136 configured to receive the collated objects from collection channel(s) 134 in a stacked format. Accumulation area 112 further includes one or more sensor(s) 138 coupled to collection tray 136 and configured to detect the presence of collated objects within collection tray 136.

In one example, accumulation area 112 further includes motor 140 configured to rotate the collection tray to a second position in response to the presence of collated objected detected by sensor(s) 138. As described in more detail below, collection tray 136 can be rotated to, for example, a process line for disposal of the collated objects onto a conveyor belt. In another example, collection tray 136 can be rotated to a storage compartment for storage of the collated objects. Motor 140 is further configured to return collection tray 136 to a first position based on the detected absence of collated objects.

In another example, accumulation area 112 can also include height adjustment mechanism(s) 142 coupled to collection tray 136. Height adjustment mechanism(s) 142 are configured to align objects of different heights as the objects are collated and collected into collection tray 136. In one example, height adjustment mechanism(s) are configured to align each collated object at each object's top edge. In this way, the objects collated and collected into collection tray 136 are uniformly aligned at one edge for delivery into storage compartments or other processing equipment. The number of height adjustment mechanisms 142 utilized in collating system 100 is relative to the number of feeders 108 and corresponding channels 128. For example, if four feeders 108 and four corresponding channels 128 are operating, four height adjustment mechanisms 142 can be implemented for each object traveling through the respective channels 128 and into the respective receiving portion of collection tray 136. Each height adjustment mechanism 142 can include, for example, an adjustment knob coupled to collection tray 136 that, upon actuation, adjusts the height at which the object is received within collection tray 136. For instance, a user can actuate adjustment mechanism 142 to raise the height of the portion of collection tray 136 where a given object will be received. In another example, height adjustment mechanism(s) 142 can automatically adjust the height of collection tray 136 at the various receiving portions relative to the detected size of objects disposed within feeder(s) 108. As collated objects are aligned by height adjustment mechanism(s) 142 within collection tray 136 and subsequently removed from collection tray 136, sensor(s) 138 detect the removal of the objects and send a sensor signal that causes feeder(s) 108 to dispense the next one or more objects through channel(s) 128 for collation. Additionally, it is expressly contemplated that accumulation area 112 can include other items as well, as indicated by block 144.

Figure 2:
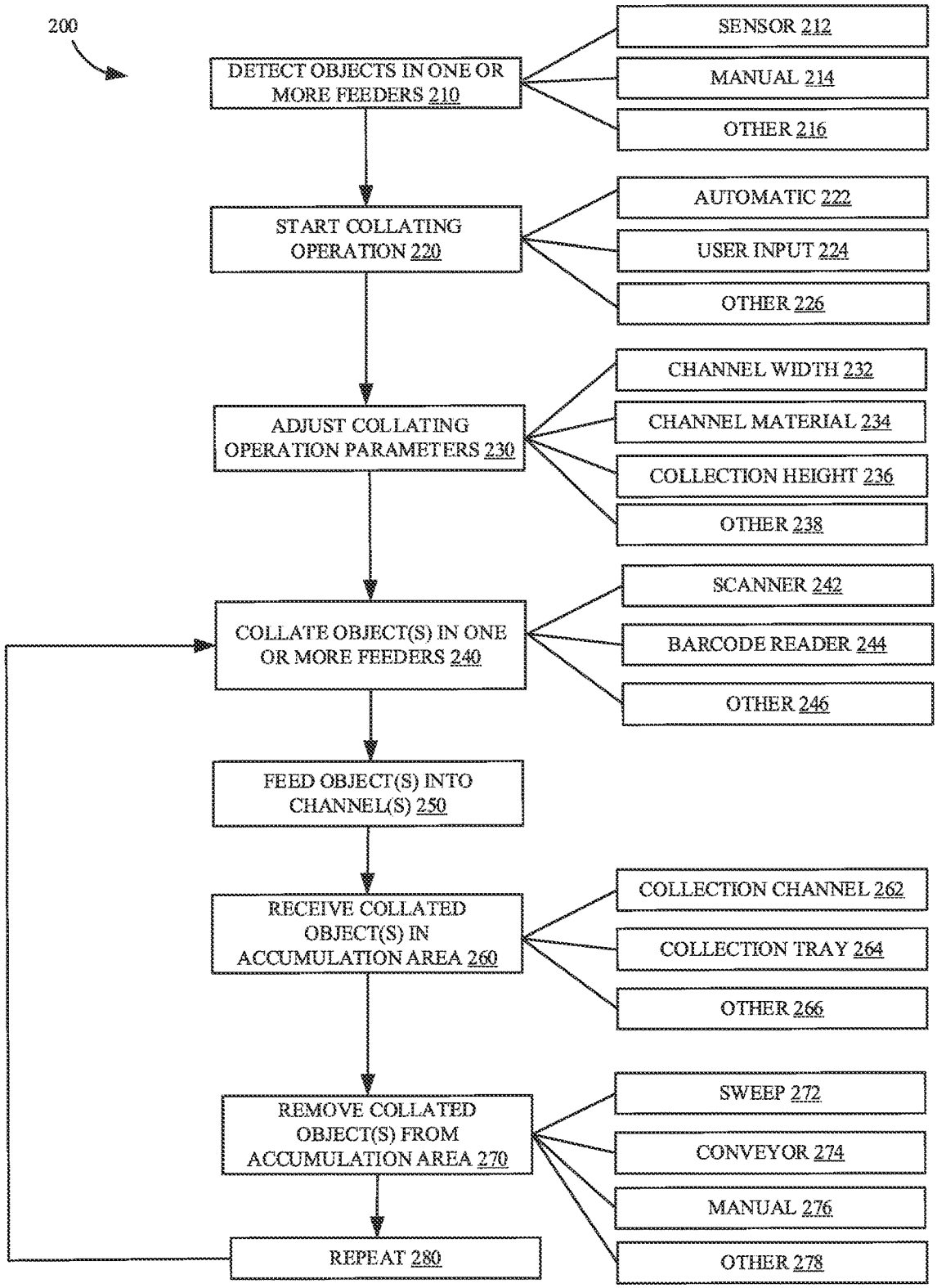
FIG. 2 is a flow diagram showing an example operation of a collating system.

FIG. 2 is a flow diagram showing an example operation of a collating system. Operation 200 begins at block 210 where a stack of objects placed within one or more feeders is detected. As indicated by block 212, detection of the objects within the feeders can be accomplished by, for example, a sensor. As indicated by block 214, detection of the objects within the feeders can also occur manually, such as by visual detection by a user. Additionally, it is expressly contemplated that the objects can be detected in the feeder in other ways as well, as indicated by block 216.

Operation 200 proceeds at block 220 where the collating operation is initiated. As indicated by block 222, the collating operation can start automatically. For example, the collating system can detect the presence of objects within the feeders by a sensor and automatically begin the collating operation based on the sensed objects. As indicated by block 224, the collating operation can also begin by user input. The user input can be, for example, an input from an operator interacting with a user interface on a display. The user input can also include, for instance, an indication of collating time, the number of objects to be collated, what the objects should be collated according to (e.g., page number, date, etc.), and other examples as well. User input at block 224 signals a control system to begin actuation of the various components of the collating system. As indicated by block 226, the collating operation can be initiated in other ways as well.

Operation 200 proceeds at block 230 where collating operation parameters are adjusted. Prior to collating the one or more objects placed in the feeders, parameters of the collating operation can be adjusted relative to the objects to be collated. As indicated by block 232, adjusting collating operation parameters can include adjusting the width of the friction-resistant channels relative to the objects to be collated. For example, the width of the channels can be adjusted relative to the size of the objects traveling through the channel(s) or based on the material composition of the objects traveling through the channel(s). The width of each channel can be adjusted relative to the characteristics of the objects such that frictional force against each object is minimized as the object travels through the channel.

As indicated by block 234, adjusting collating operation parameters can also include adjusting the channel material disposed within each of the utilized channels. Channel material can be adjusted relative to the material type of the objects traveling through the channel(s). For example, if the objects to be collated are formed from cardboard, a particular material may be desired for use within the interior of the channel(s) in order to minimize the coefficient of friction between the object and the channel interior. In this way, the coefficient of friction between each channel and the objects can be changed (e.g., minimized) to best suit the material type of the objects traveling through the channel(s). In one example, the channel material can be changed by using removable guide strips, such as those described below with respect to FIGS. 4A-4F. However, it is expressly contemplated that the channel material can be changed in other ways as well.

As indicated by block 236, the height at which the objects are collected can also be adjusted. For example, the height at which the objects are collected into a collection tray can be adjusted such that the respective top edge of each collated object is uniformly aligned as the object is received by the collection tray. In this way, the objects collated and collected into the collection tray are aligned along at least one edge for delivery into storage compartments or other processing equipment. Additionally, it is expressly contemplated that other collating operation parameters can also be adjusted as well, as indicated by block 238.

Operation 200 proceeds at block 240 where the objects within the one or more feeders are collated. The collating process involves feeding one object from each of the loaded feeders into the collating mechanism, collating the plurality of objects in proper order, and dispensing the collated objects at the accumulation area. As indicated by block 242, the objects can also optionally be scanned by a scanner during the collation process. The scanner can scan, for example, a logo, label, or other form of text on the one or more objects. In another example, as indicated by block 244, a barcode reader can also be utilized to scan a bar code on the one or more objects. Additionally, it is expressly contemplated that other ways of scanning and/or collating the objects can be utilized as well, as indicated by block 246.

Operation 200 proceeds at block 250, where the objects are fed into a respective channel. In one example, the channels are modified such that the force of friction acting against the objects as they travel through the channels is minimized. For example, the interior material of the channel can be adjusted, as indicated above with respect to block 234, such that the coefficient of friction between the objects and the channel interior is minimized. Additionally, the width of the channels can also be adjusted, thereby changing the pressure of the channel as objects travel therethrough. Therefore, by changing both the pressure acting on the objects as they travel down the channels and the material within the channel interior, the frictional force acting against the objects can also be adjusted (e.g., minimized). In this way, the objects can be transferred to the accumulation area via the effect of gravity with minimum frictional resistance. In one example, a plurality of channels are used, wherein each channel is coupled to a respective feeder. In this way, collation of each object within multiple feeders can occur whilst eliminating the possibility of misplacing and/or disorganizing collated objects.

Operation 200 proceeds at block 260 where the collated objects are received in an accumulation area. As indicated by block 262, the accumulation area can include one or more collection channels, wherein each collection channel is configured to receive the collated objects from a respective feeder by way of one or more friction resistant channels. Collated objects can be received by the collection channel and temporarily held for removal after the collation process, or can pass immediately through the collection channel into, for example, a storage container or conveyor line. As indicated by block 264, the accumulation area can also include a collection tray. As indicated above in block 236, the height at different portions of the collection tray can be adjusted such that each object is uniformly aligned at one edge as the objects are received in the collection tray. In one example, the number of adjustable portions on the collection tray is equal to the number of feeders and channels utilized in the collating operation. For instance, if four feeders and four channels are utilized, the collection tray can be adjustable at four portions where each collated object is received. Additionally, it is expressly contemplated that accumulation area can include other items as well, as indicated by block 266.

The operation proceeds at block 270 where the collated objects are removed from the accumulation area. As indicated by block 272, collated objects can be removed by, for example, a sweep mechanism in which the collated objects are collected and moved vertically into another automated system. The sweep mechanism can remove collated objects received in either the collection channels or collection tray. As indicated by block 274, collated objects can also be removed by a conveyor system. For example, a conveyor belt having a plurality of storage compartments disposed thereon can be placed beneath the accumulation area for automatic retrieval of the collated objects as they are collected into the collection channels. In this example, collated objects can be moved automatically through the collection channels by gravity such that they are removed from the collating system and retrieved with a respective storage compartment. As indicated by block 276, collated objects can also be removed from the accumulation area manually. For example, collated objects collected at the accumulation area can be removed by operator retrieval.

In the examples indicated at blocks 272, 274 and 276, a sensor can be disposed at the accumulation area that senses removal of the previously collated objects and sends a sensor signal indicating that the next one or more objects can be dispensed from the feeders for collation. Additionally, it is expressly contemplated that other ways of removing the collated object(s) from the accumulation area can occur as well, as indicated by block 278.

After the collation process of the one or more objects has been completed and the collated objects have been removed, the operation proceeds at block 280 where the operation is repeated at block 240. Specifically, if the collation of additional objects within the feeders is necessary, operation 200 proceeds at block 240 where the additional objects from each feeder are collated. The operation can repeat at block 280 any number of times until all objects disposed within the feeders have been collated and removed at the accumulation area.

Figure 3:
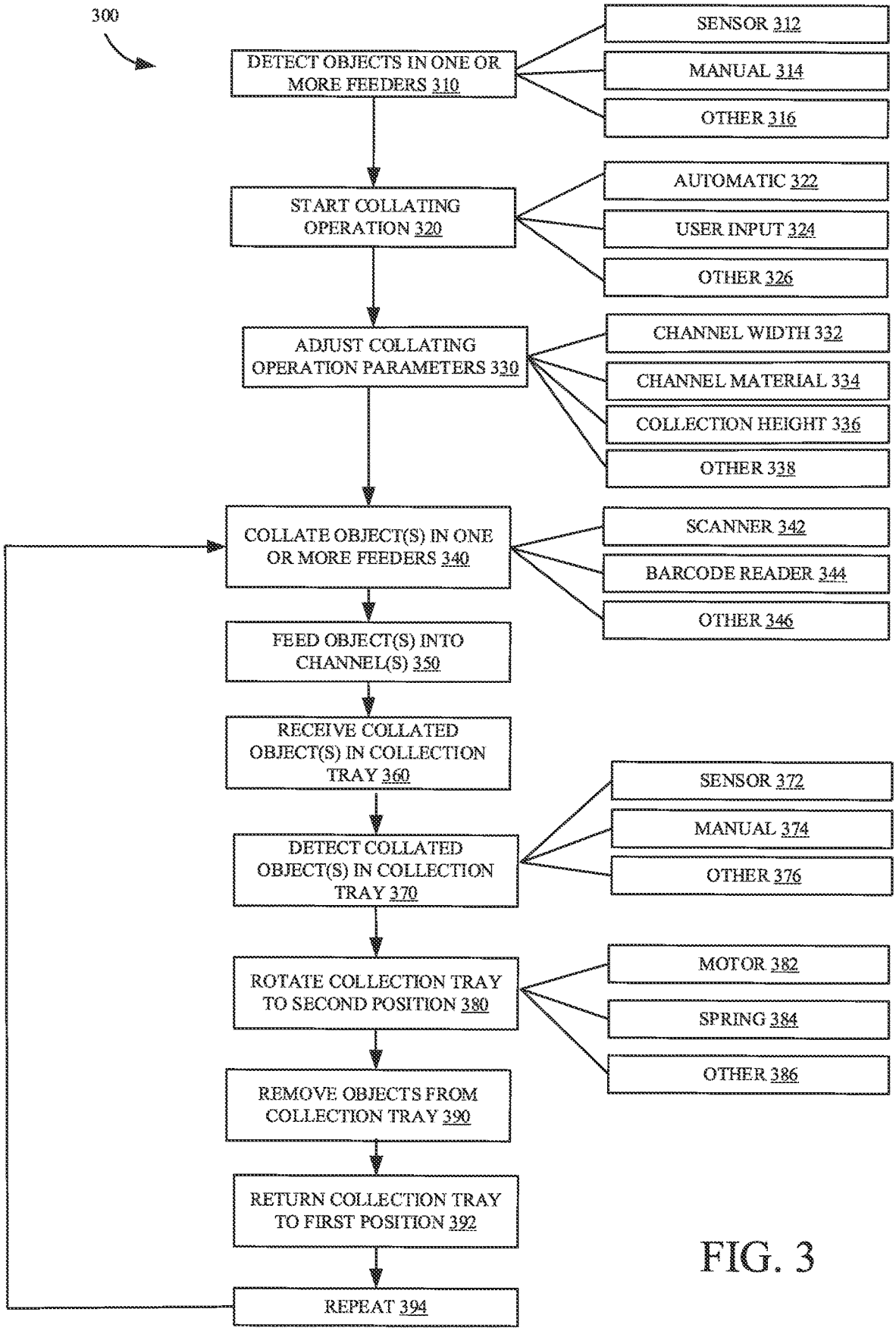
FIG. 3 is a flow diagram showing an example operation of a collating system.

FIG. 3 is a flow diagram showing an example operation of a collating system. FIG. 3 bears some similarities to FIG. 2, and like components are numbered and described accordingly. Operation 300 begins at block 310 where a stack of objects placed within one or more feeders is detected. As indicated by block 312, detection of the objects within the feeders can be accomplished by, for example, a sensor. The sensor can include, for example, an optical sensor that optically detects the presence of objects within the feeders. In another example, the sensor can include a mechanical sensor that detects the presence of one or more objects within the feeders by weight and/or contact with the object(s). As indicated by block 314, detection of the objects within the feeders can also occur manually, such as by visual detection by a user. Additionally, it is expressly contemplated that the objects can be detected in the feeder in other ways as well, as indicated by block 316.

Operation 300 proceeds at block 320 where the collating operation begins. As indicated by block 322, the collating operation can start automatically. For example, the collating system can detect the presence of objects within the feeders by a sensor and automatically begin the collating operation based on the detected objects. As indicated by block 324, the collating operation can also begin by user input. The user input can be, for example, an input from the operator interacting with a user interface on a display. The user input can also include, for instance, an indication of collating time, the number of objects to be collated, what the objects should be collated according to (e.g., page number, date, etc.), and other examples as well. User input at block 324 signals a control system to begin actuation of the various components of the collating system. As indicated by block 326, the collating operation can be started in other ways as well.

Operation 300 proceeds at block 330 where collating operation parameters are adjusted. Prior to collating the one or more objects placed in the feeders, parameters of the collating operation can be adjusted relative to the objects to be collated. As indicated by block 332, adjusting collating operation parameters can include adjusting the width of the friction-resistant channels relative to the objects to be collated. For example, the width of the channels can be adjusted relative to the size of the object traveling through the channel(s) or based on material composition of the objects traveling through the channel(s). The width of each channel can be adjusted relative to the characteristics of the objects such that frictional force against the object is minimized as the object travels through the channel.

As indicated by block 334, adjusting collating operation parameters can also include adjusting the channel material disposed within each of the utilized channels. Channel material can be adjusted relative to the characteristics of the objects traveling through the channel(s). For example, if the objects to be collated are formed from cardboard, a particular material may be desired for use within the interior of the channel(s) in order to minimize the coefficient of friction between the object and the channel interior. In this way, the coefficient of friction between each channel and the objects can be changed (e.g., minimized) to best suit the material composition of the objects traveling through the channel. In one example, the channel material can be changed by using removable guide strips, such as that described below with respect to FIGS. 4A-4F. However, it is expressly contemplated that the channel material can be changed in other ways as well.

As indicated by block 336, the height at which the objects are collected can also be adjusted. For example, the height at which the objects are collected into a collection tray can be adjusted such that the respective top edge of each collated object is uniformly aligned as the object is received by the collection tray. In this way, the objects collated and collected into the collection tray are aligned at one edge for delivery into storage compartments or other processing equipment. Additionally, it is expressly contemplated that other collating operation parameters can also be adjusted as well, as indicated by block 338.

Operation 300 proceeds at block 340 where the objects within the one or more feeders are collated. The collating process involves feeding one object from each of the loaded feeders into the collating mechanism, collating the plurality of objects in proper order, and dispensing the collated objects at the accumulation area. As indicated by block 342, the objects can also optionally be scanned by a scanner during the collation process. The scanner can scan, for example, a logo, label, or other form of text on the one or more objects. In another example, as indicated by block 344, a barcode reader can also be utilized to scan a bar code on the one or more objects. Additionally, it is expressly contemplated that other ways of scanning and/or collating the objects can be utilized as well, as indicated by block 346.

Operation 300 proceeds at block 350, where the objects are fed into a respective channel. In one example, the channels are modified such that the force of friction acting against the objects as they travel through the channels is minimized. For example, the interior material of the channel can be adjusted, as indicated above with respect to block 334, such that the coefficient of friction between the object(s) and the channel interior is minimized. Additionally, the width of the channels can also be adjusted, thereby changing the pressure of the channel as the objects travel therethrough. Therefore, by changing both the pressure acting on the objects as they travel down the channels and the material within the channel interior, the frictional force acting against the objects can also be adjusted (e.g., minimized). In this way, the objects can be transferred to an accumulation area via the effect of gravity and with minimum frictional resistance. In one example, a plurality of channels are used, wherein each channel is coupled to a respective feeder. In this way, collation of each object within multiple feeders can occur whilst eliminating the possibility of misplacing and/or disorganizing collated objects.

Operation 300 proceeds at block 360 where the collated objects are received in a collection tray. As noted above, a collection channel is coupled to the friction resistant channels and configured to receive the collated objects from a respective feeder. By disposing a collection tray at the distal end of the collection channels, the collection tray can receive the collated objects dispensed from each collection channel. In one example, the collection tray can include one or more height stops that align the collated objects at the respective top edge of each collated object. In this way, the objects collated and collected into the collection tray are uniformly aligned at one edge for delivery into storage compartments or other processing equipment.

Operation 300 proceeds at block 370, where collated objects within the collection tray are detected. As indicated by block 372, the objects can be detected within the collection tray by, for example, a sensor disposed within or near the collection tray. As indicated by block 374, the objects can also be detected manually, such as by operator observation. Additionally, it is expressly contemplated that the objects can be detected in the collection tray in other ways as well, as indicated by block 376.

Operation 300 proceeds at block 380 where the collection tray is rotated to a second position in response to the detected presence of objects. The collection tray can be rotated to any desired second position to facilitate removal of the collated objects. For example, the collection tray can be rotated to a second position, which allows subsequent feeding of the objects to a conveyor line. In another example, the collection tray can be rotated to a second position corresponding to a storage compartment. As indicated by block 382, the collection tray can be rotated by a motor operated by the control system. In another example, as indicated by block 384, the collection tray can also be rotated by a spring mechanism that allows the collection tray to fall to the second position and then return to the first position by a force applied from a spring. Additionally, it is expressly contemplated that the collection tray can be rotated to the second position in other manners as well, as indicated by block 386.

Operation 300 proceeds at block 390, where the objects are removed from the collection tray at the second position. As described in more detail below with respect to FIGS. 5A-6, the objects can be removed from the collection tray by a conveyor belt (e.g., a lug conveyor belt, etc.). In another example, the objects can be removed by rotating the collection tray such that the objects fall out of the tray at a desired location. Additionally, it is expressly contemplated that the objects can be removed from the collection tray in other ways as well.

Operation 300 proceeds at block 392 where the collection tray is returned to the original first position after removal of the collated objects. As noted above, the collection tray can be returned to the first position by, for example, a motor. In another example, a spring mechanism can return the collection tray to the first position. Additionally, it is expressly contemplated that the collection tray can be returned to the first position in other ways as well (e.g., by operator force, etc.).

After the collation process of the one or more objects has been completed, the collated objects have been removed from the collection tray, and the collection tray has returned to the first position, the operation proceeds at block 394 where the operation is repeated at block 340. Specifically, if the collation of additional objects within the feeders is necessary, operation 300 proceeds at block 340 where the additional objects are collated. The operation can repeat at block 394 any number of times until all objects disposed within the feeders have been collated and transferred to and from the collection tray.

Figure 4A:
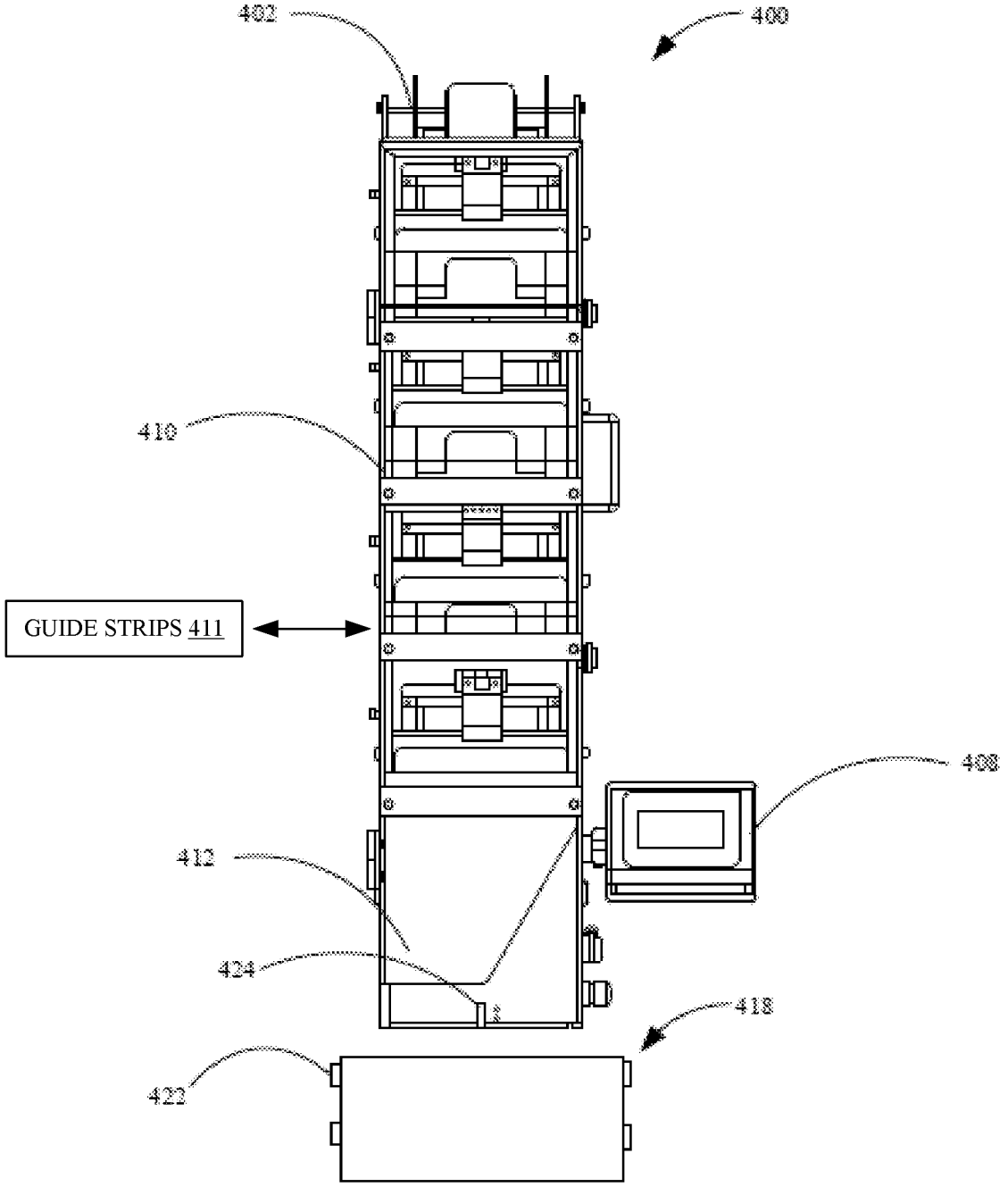
FIGS. 4A-4F illustrate an example collating system.
Figure 4B:
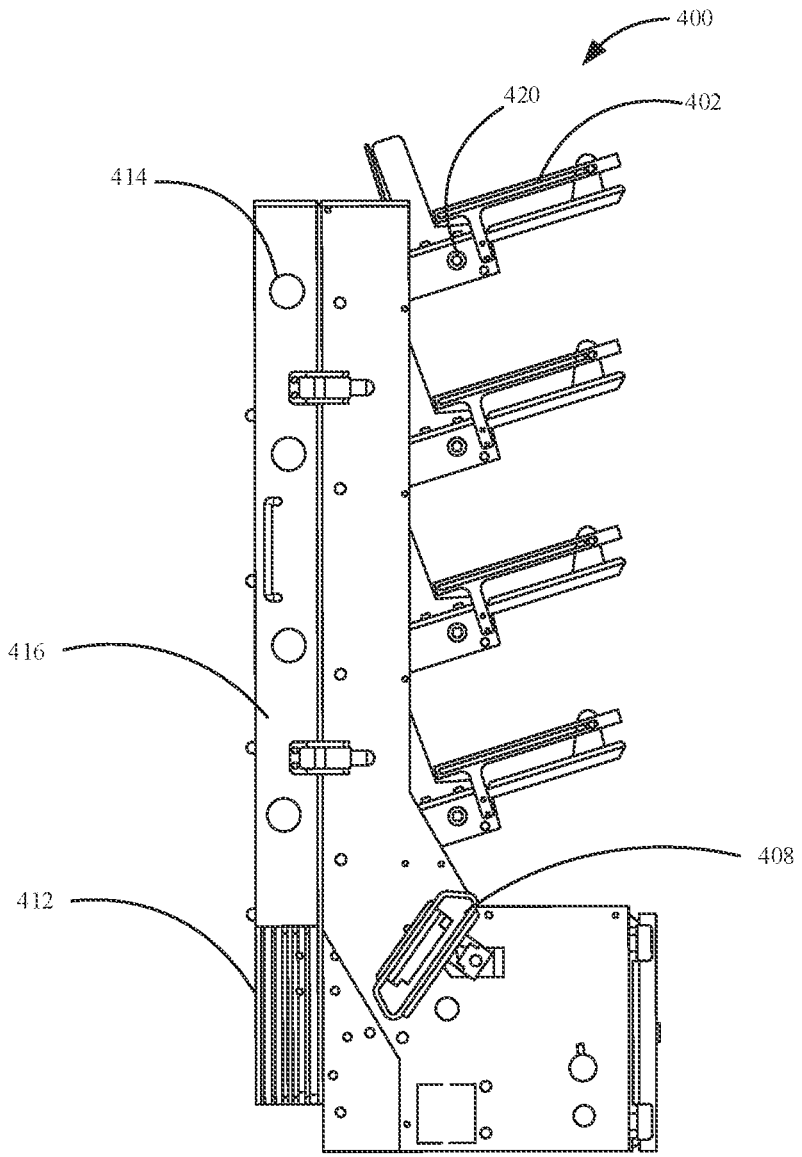
Figure 4C:
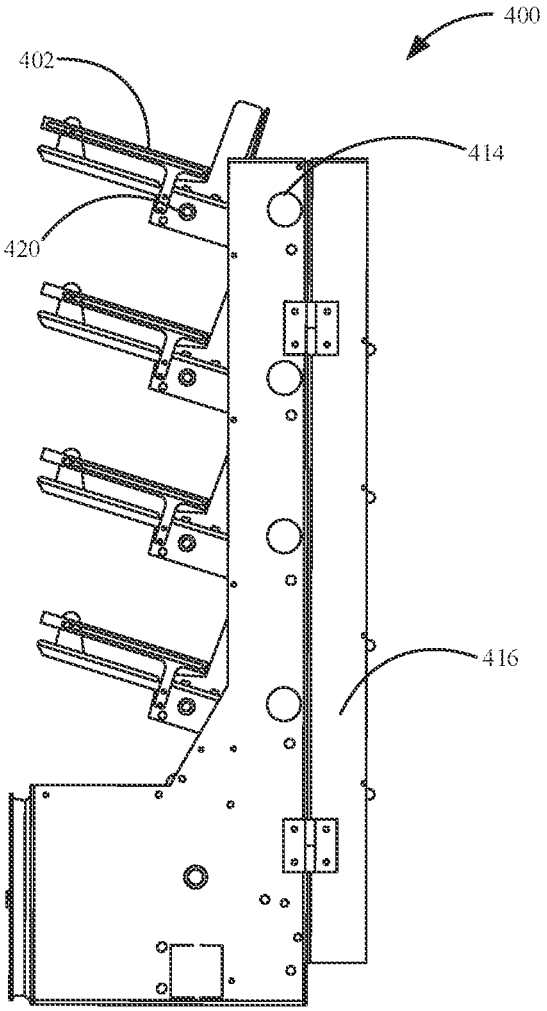
Figure 4D:
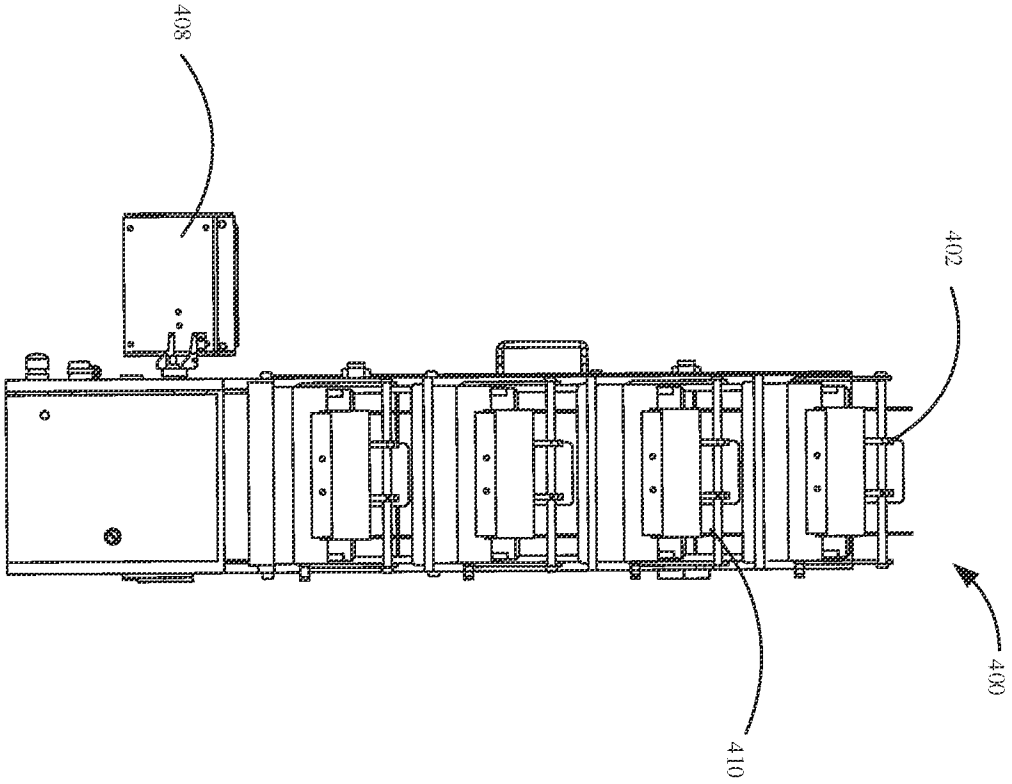
Figure 4E:
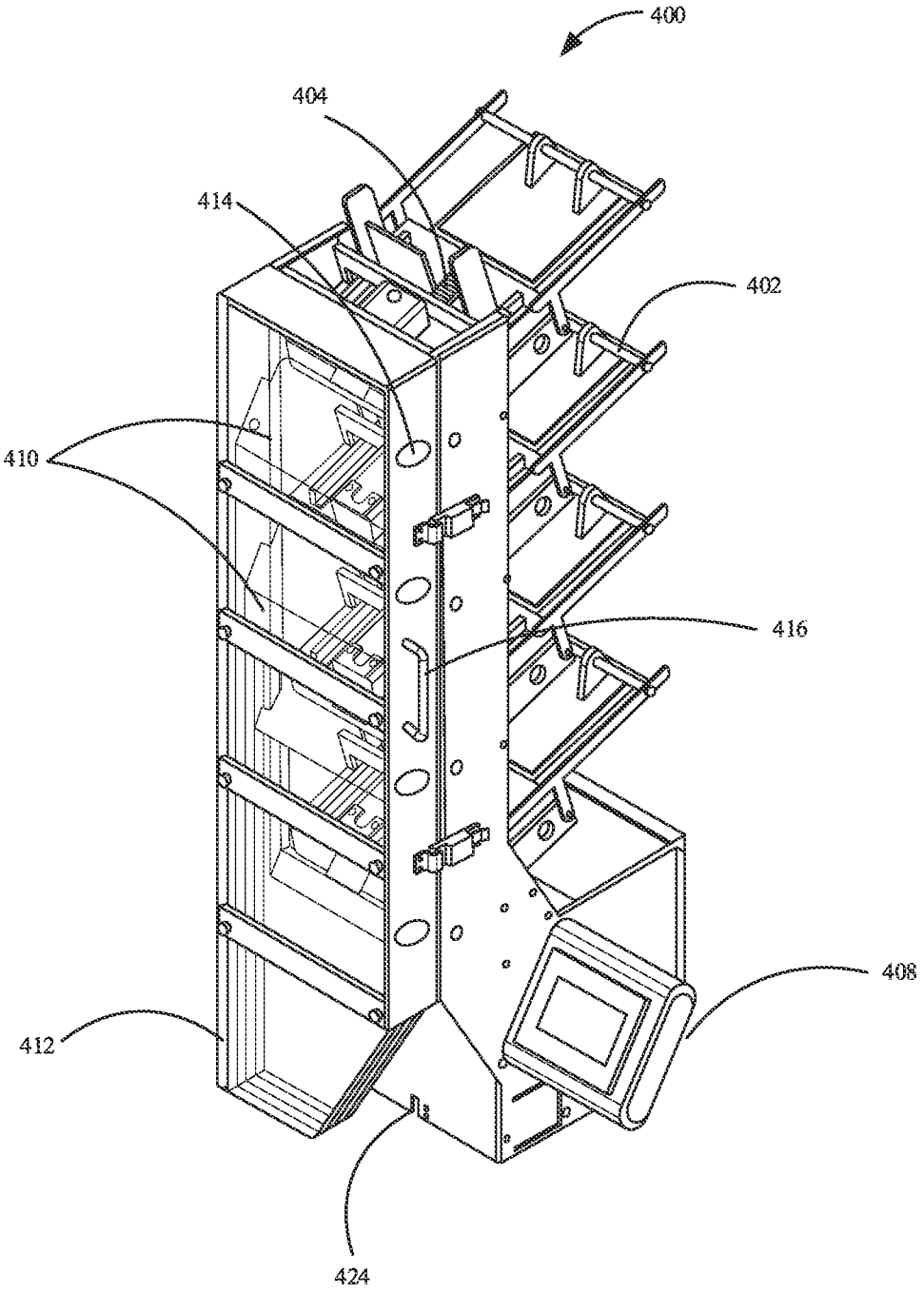
Figure 4F:
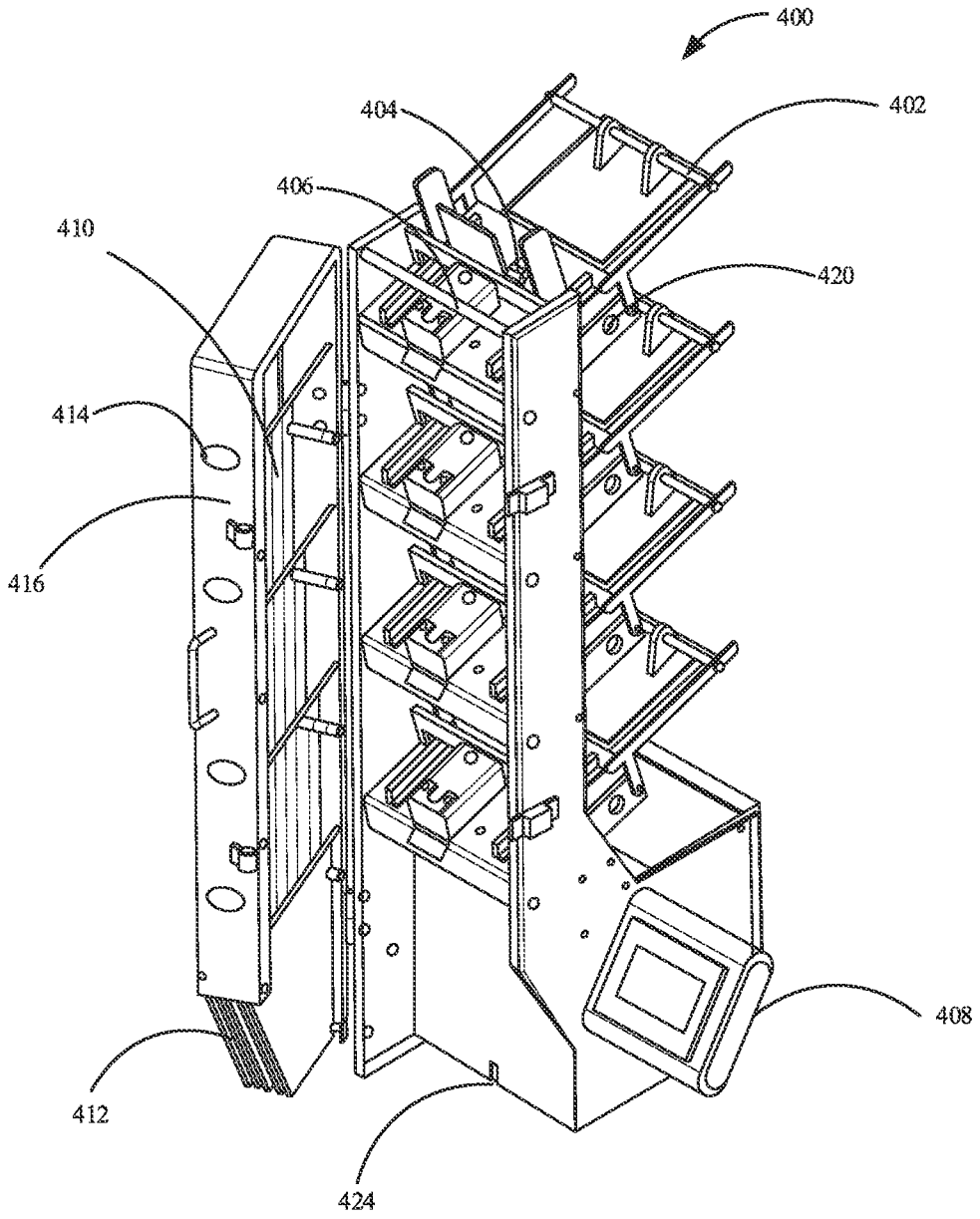
Figure 5A:
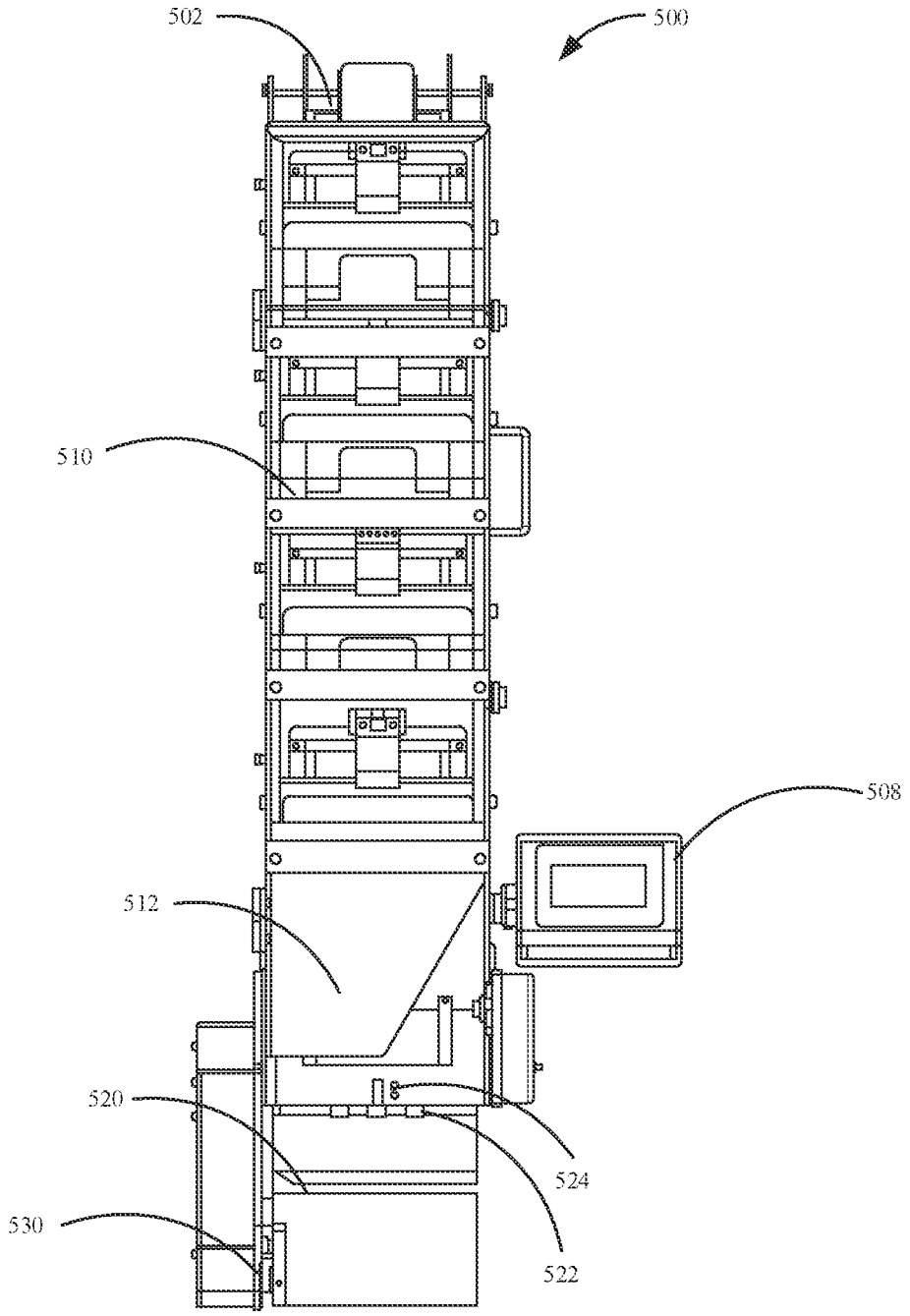
FIGS. 5A-5E illustrate an example collating system.
Figure 5B:
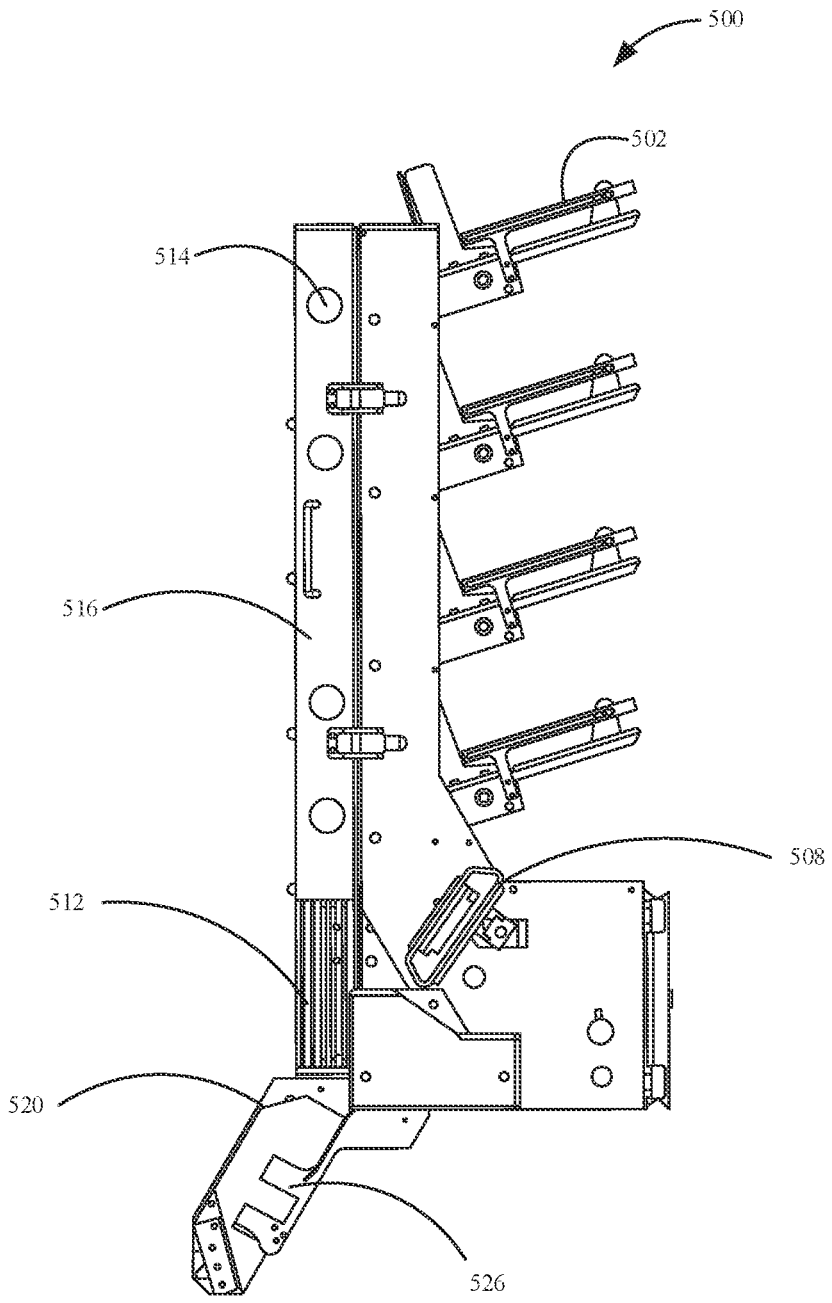
Figure 5C:
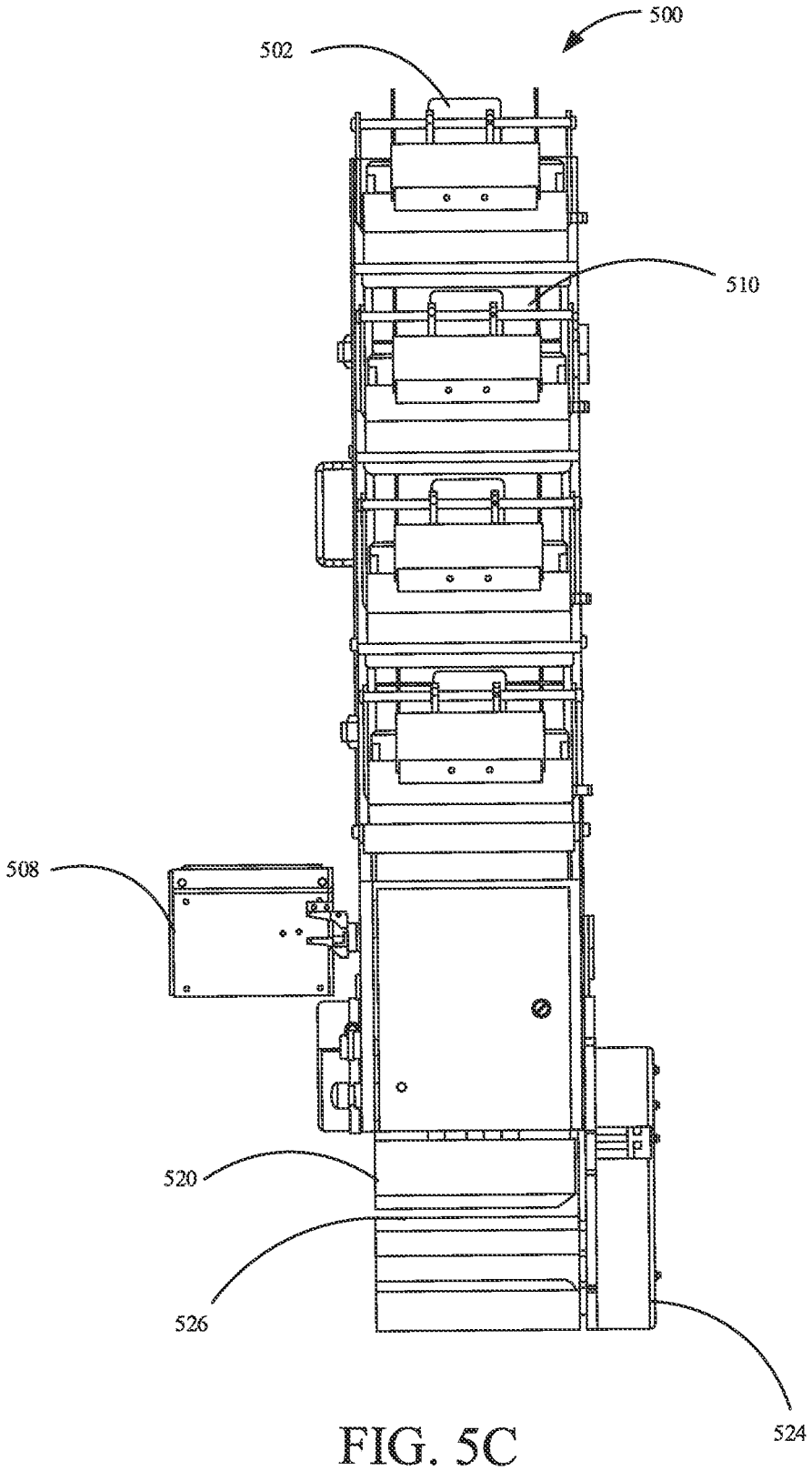
Figure 5D:
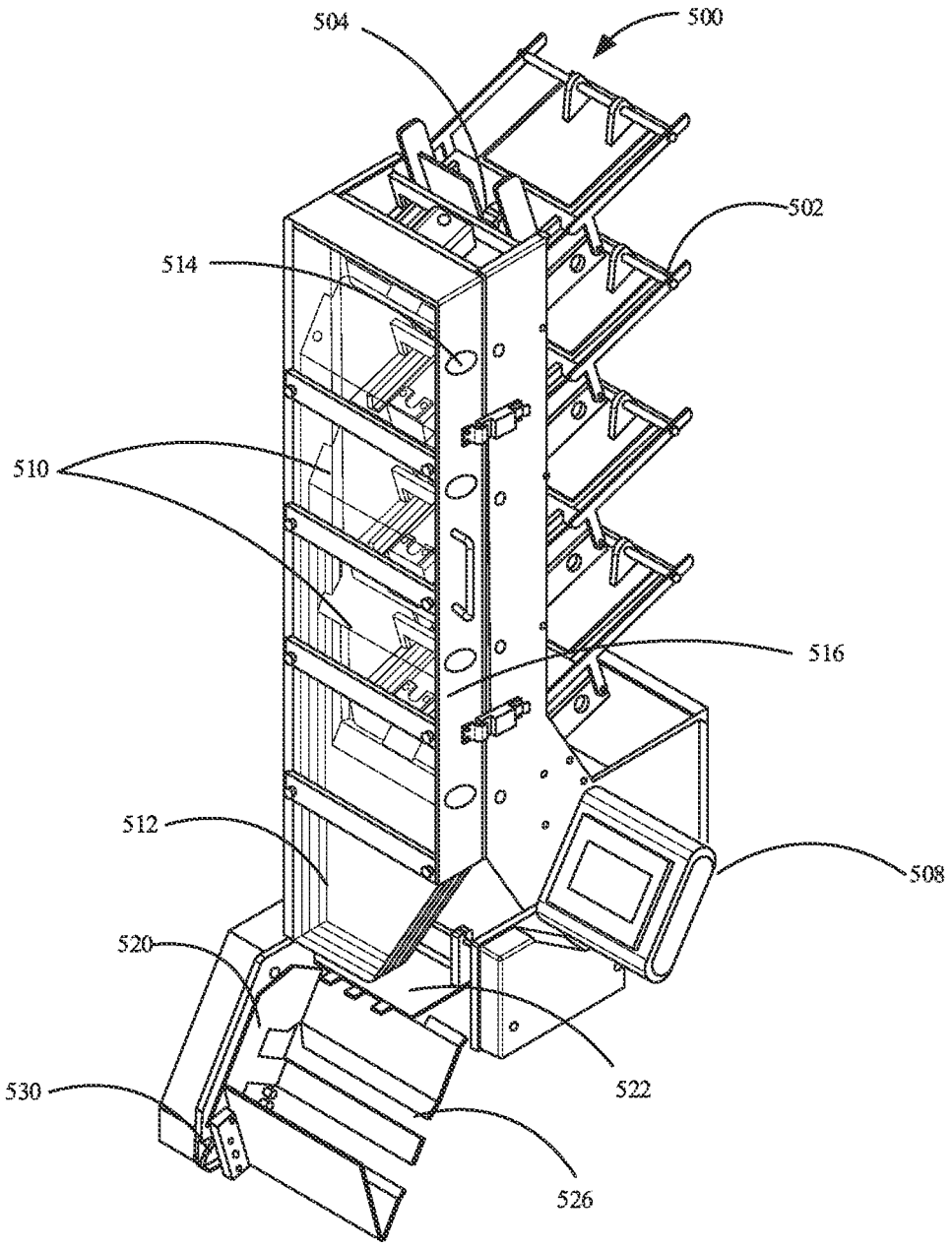
Figure 5E:
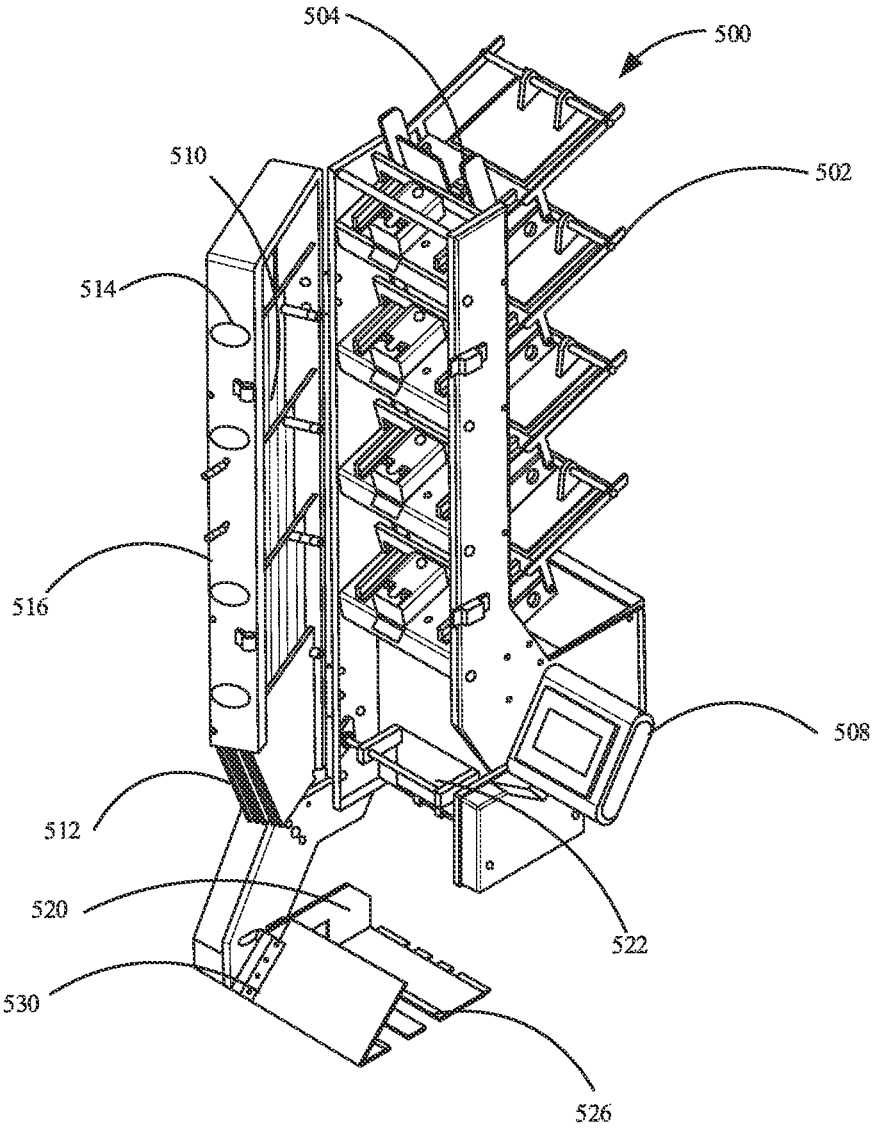

FIGS. 4A-4F illustrate an example collating system 400. As shown, collating system 400 illustratively includes feeders 402 configured to receive and hold a plurality of objects to be collated. As shown in FIG. 4B, four feeders are disposed within the collating system in a vertical orientation, allowing for a compact configuration of collating system 400. Additionally, while four feeders are shown in the present example, it is expressly contemplated that more or less feeders can also be utilized relative to the desired level of collating. The feeders can be sized relative to the size of the objects to be collated. As shown in FIG. 4E, feeder 402 illustratively includes friction belt 404 generally coupled to a respective feeder bin 402 that holds the objects to be collated. Friction belt 404 is configured feed objects disposed in the bin of feeder 402 into channels 410. Friction belt 404 operates in a bottom-to-top configuration. That is, friction belt 404 feeds an individual object from the bottom of a stack of objects towards the respective channel 410. Feeder 402 also includes electronics housing 406 (shown in FIG. 4F) configured to house the electronics required to operate feeder 402 therein.

Feeder(s) 402 are removably couplable to collating system 400 by the use of one or more coupling mechanisms 420. As shown, each feeder 402 is a self-contained module having all operational hardware disposed therein. For example, each feeder 402 includes a friction belt 404, feeder bin, one or more rollers (not shown), and electrical components within electronic housing 406 assembled as a compact unit. In one example, coupling mechanism 420 includes one or more screws that secure feeder(s) 402 to collating system 400. In another example, coupling mechanism 420 can include one or more user actuatable knobs that secure feeder(s) 402 to collating system 400. In operation, coupling mechanism 420 allows feeder(s) 402 to be secured to and detachable from collating system 400. In this way, each utilized feeder 402 can be easily removed from collating system 400. For example, if feeder 402 undergoes a mechanical error, the feeder unit may need to be replaced. Because feeder(s) 402 are self-contained modules, the feeder unit can be easily removed and replaced by coupling mechanism 420 without having to further inhibit or otherwise deactivate operation of collating system 400. Further, additional feeders 402 can be retrofitted by coupling mechanism 420 without having to halt operation of collating system 400. For example, a user operating collating system 400 with two feeders 402 can add additional feeders 402 via coupling mechanism 420, if desired.

Collating system 400 also includes display screen 408 configured to display a user interface for user input. As noted above, the user input can include, for example, an indication of whether to start the collating operation, the collating time, the number of objects to be collated, what the objects should be collated according to (e.g., page number, date, etc.), and other examples as well. In some examples, display screen 408 can also display the progress of the collating operation and indicate when the collating operation has completed.

As indicated above, collating system 400 illustratively includes one or more channels 410. As shown more clearly in FIG. 4D, a plurality of channels can be used relative to the number of feeders in the collating system. For example, four channels are used in a system with four feeders, wherein one channel is coupled to one respective feeder. Each channel 410 is configured to transfer the collated objects to the bottom portion of collating system 400 at collection channels 412. In one example, each channel 410 is formed of a friction resistant material that minimizes frictional resistance against the objects as they are transferred through channel 410. Specifically, the friction resistant material has a high abrasion resistance, low coefficient of friction with the objects fed into channel 410, and high impact strength. In this way, as each object is collated, the object can be transferred through channel 410 and to collection channel 412 solely by the force of gravity.

The friction resistant material used in channel(s) 410 should be selected such that the coefficient of friction between channel(s) 410 and the one or more objects traveling therethrough is minimized. As used herein, "friction-resistant" material means a material utilized such that the relative coefficient of friction between the material and the objects traveling through the channels is less than 0.8.

For example, the material used in channel(s) 410 can be an ultra-high molecular weight (UHMW) plastic material. In another example, the material used in channel(s) 410 can be stainless steel. In some examples, the relative coefficient of friction between the channels and the one or more objects can be in a range of 0.13-0.72. For instance, if the material type of the objects traveling through channel(s) 410 is of cardboard, the friction-resistant material used in the interior of the respective channel 410 should be selected such that the relative coefficient of friction between the channel and the cardboard objects is minimized. In another example, if the material type of the objects is of paper, the friction-resistant material used in the interior of the respective channel 410 should be selected such that the relative coefficient of friction between the channel and the paper objects is minimized. The material utilized in the interior of channel (s) 410 can be changed by, for example, replaceable guide strips 411 that are configured to be removably coupled to the interior of channel(s) 410. In one example, the guide strips 411 are configured to be removably coupled to collection channel(s) 412 and extend through the interior of channel(s) 410. The guide strips 411 can be couplable by, for example, a snap mechanism. In another example, the guide strips 411 can be fastened at collection channel(s) 412 and extend through channel(s) 410 by one or more threaded fasteners (e.g., screws). Additionally, it is expressly contemplated that the guide strips 411 can be secured to channel(s) 410 in other ways as well. In one example, ⅛-inch of friction resistant material is used per channel 410. However, it is expressly contemplated that a different amount of friction resistant material can be used per channel as well.

Collating system 400 also illustratively includes one or more channel adjustment mechanism(s) 414. As shown, each channel adjustment mechanism 414 is disposed adjacent to and coupled to a respective channel of the one or more channel(s) 410. For instance, in the example shown in FIGS. 4A-4F, four channel adjustment mechanisms 414 are utilized, corresponding to four channels 410 and four feeders 402. Channel adjustment mechanism(s) 414 are configured to adjust the channel width of the respective channel 410 upon actuation. For example, upon actuation, channel adjustment mechanism 414 can increase or decrease the width of a respective channel 410 relative to the objects traveling therethrough. Channel adjustment mechanism 414 can include one or more adjustment knobs 414 that adjust channel width of the respective channel 410 upon actuation by an operator. In one example, two adjustment knobs 414 can be utilized, wherein a second adjustment knob 414 is disposed on the opposing side of compartment door 416 relative to the respective adjustment knob 414 (shown in FIG. 4C). In this example, each adjustment knob 414 is configured to adjust the width of the respective channel 410 by adjusting a respective plane of channel 410. As one plane of channel 410 is adjusted by the first adjustment knob 414, the other plane of channel 410 is adjusted by the second adjustment knob 414. However, in another example, only one adjustment knob 414 can be utilized to adjust the width of channel 410. In operation, an operator can rotate each adjustment knob 414 in a first direction to increase the width of the respective channel 410 and rotate each adjustment knob 414 in a second direction to decrease the width of the respective channel 410. Additionally, in other examples, channel adjustment mechanism 414 can be an automatic adjustment mechanism, in which channel adjustment mechanism 414 automatically adjusts the width of the respective channel 410 relative to the size of sensed objects traveling through channel 410.

By adjusting the width of channel 410 by channel adjustment mechanism(s) 414, the pressure of the channel acting on the objects as they travel against the interior material of channel 410 is also adjusted. For example, when channel adjustment mechanism 414 is actuated to increase the width of channel 410, the pressure acting on the objects as they travel against the interior material of channel 410 decreases. In another example, when channel adjustment mechanism 414 is actuated to decrease the width of channel 410, the pressure acting on the objects as they travel against the interior material of channel 410 increases. Therefore, as the width of channel 410 is adjusted by actuation of the one or more channel adjustment mechanism(s) 414, the frictional force acting against the objects is also adjusted as the objects travel through channel 410. For example, an operator may wish to adjust the width of channel 410 relative to the size of the object traveling through channel 410. In another example, an operator may wish to adjust the width of channel 410 relative to the type of material the object consists of. In these examples, channel adjustment mechanism 414 can adjust the width relative to the characteristics of the object such that frictional force against the object is minimized as the object travels through channel 410.

Accordingly, frictional force acting against the objects traveling through the one or more channels 410 can be adjusted by both modifying the interior material of channel 410 and by modifying the width of channel 410 to adjust the pressure at which the objects are moving against the interior of channel 410. In particular, by adjusting the interior material of channel 410, the coefficient of friction is adjusted between channel 410 the one or more objects traveling therethrough. By adjusting the pressure at which the objects are moving against the interior of channel 410, the normal force of the one or more objects acting against the interior of channel 410 is also adjusted. By adjusting either the coefficient of friction or the normal force, the frictional force acting against the one or more objects traveling within channel 410 is consequently adjusted.

As each object is collated and falls through the respective channel 410, the object is transferred to a respective collection channel 412. As shown more clearly in FIG. 4F, each collection channel can be seen as a slot that receives collated objects. In the example shown with four feeders and four friction resistant channels, four collection channels 412 are utilized. However, it is expressly contemplated that a different number of collection channels can be utilized as well, relative to the number of feeders being implemented. In operation, as one or more objects are transferred through channel 410 and to collection channel(s) 412, the collated objects can be prepared for removal. For example, collating system 400 can optionally include collection tray 418 (shown in FIG. 4A) configured to receive the collated objects as they pass through channel(s) 410 and collection channel(s) 412. As shown, collection tray 418 includes one or more height adjustment mechanism(s) 422. Height adjustment mechanism(s) 422 are configured to align objects of different heights as they are collated and collected into collection tray 418. In one example, height adjustment mechanism(s) 422 are configured to align the collated objects at the respective top edge of each object. In this way, the objects collated and collected into collection tray 418 are uniformly aligned along at least one edge for delivery into storage compartments or other processing equipment. The number of height adjustment mechanisms 422 utilized in collating system 400 is relative to the number of feeders 402 and corresponding channels 410. For instance, in the example shown in FIGS. 4A-4F, four height adjustment mechanisms 422 are utilized, corresponding to four feeders 402 and four corresponding channels. Each height adjustment mechanism 422 can include, for example, an adjustment knob 422 coupled to collection tray 418 that, upon actuation, adjusts the height of where the object is received within collection tray 418. For instance, a user can actuate adjustment mechanism 422 to raise the height of the portion of collection tray 418 where a given object will be received. In another example, height adjustment mechanism(s) 422 can automatically adjust the height of collection tray 418 at the various receiving portions relative to the detected size of objects disposed within feeder(s) 402.

Collated objects can be removed in different ways, such as those described above with respect to FIG. 2. For example, a sweep mechanism (not shown) can be utilized that collects the collated objects and moves the objects vertically into another automated system. The sweep mechanism can remove collated objects received in either collection channels 412 or collection tray 418. In another example, the collated objects can be removed by a conveyor system (not shown). For instance, a conveyor belt having a plurality of storage compartments disposed thereon can be placed beneath collection channels(s) 412 for automatic retrieval of the collated objects as they pass through collection channel (s) 412. In this example, collated objects can be moved automatically through collection channel(s) 412 by gravity such that they are removed from collating system 400 and retrieved in a respective storage compartment. In another example, collated objects can also be removed from collection channel(s) manually.

As shown, a sensor 424 is disposed at the bottom portion of collating system 400 adjacent to collection channels 412 and is configured to detect when the one or more objects have been removed. In response, a sensor signal is sent to a control system (e.g., control system 102) indicative of the detected object removal. Consequently, the control system controls collating system 400 to automatically feed in the next object(s) from feeder(s) 402 for collation. This process can continue in repetition until all desired objects have been collated and removed from collating system 400.

As indicated above, collating system 400 also illustratively includes compartment door 416 configured to allow an operator to access the inner components of collating system 400. For example, an operator can access the interior of feeder(s) 402 and friction resistant channels 410 for any necessary operator service and/or repair.

FIGS. 5A-5E illustrate an example collating system. FIGS. 5A-5E bears many similarities to FIGS. 4A-4F, and like components are numbered accordingly. For example, collating system 500 illustratively includes feeders 502, friction belts 504, screen display 508, friction resistant channels 510, collection channels 512, channel adjustment mechanisms 514, compartment door 516, and sensor 524. In one example, feeders 502, friction belts 504, screen display 508, friction resistant channels 510, collection channels 512, channel adjustment mechanisms 514, compartment door 516, and sensor 524 are similar to, respectively, feeders 402, friction belts 404, screen display 408, friction resistant channels 410, collection channels 412, channel adjustment mechanisms 414, compartment door 416, and sensor 524 discussed above with respect to FIGS. 4A-4F.

As shown in FIGS. 5A-5E, collating system 500 additionally includes collection tray 520. As shown, collection tray 520 is disposed at the bottom portion of collating system 500 near collection channels 512 and is staged in the first position by staging tray 522. In operation, as objects are collated and transferred through friction resistant channels 510 and to collection channels 512, the objects are guided from collection channels 512 into collection tray 520. A sensor (not shown) is disposed within collection tray 520 and is configured to detect the presence of a collated stack of objects within the collection tray. Upon completion of the collating operation and detection of objects within collection tray 520, a motor 530 drives rotation of collection tray 520 to a second position (shown in FIG. 5E) for object removal. Collection tray 520 further includes slots 526 to aid in the collated object removal process. For example, collection tray 520 can be lowered onto a conveyor line (shown in FIG. 6) such that slots 526 enable the conveyor line to come into contact with the objects disposed within collection tray 520. In this way, the objects disposed within collection tray 520 can be removed effectively. In another example, collection tray 520 can be rotated to a second position such that the collated objects slide out of the tray and into a storage compartment. Additionally, it is expressly contemplated that collection tray 520 can be rotated to any other desired second position by motor 530 as well.

Upon removal of the objects from collection tray 520, the sensor (not shown) can detect that the objects are no longer present and transmit a sensor signal to the control system indicating that collection tray 520 should be returned to the first position at staging tray 522. Upon receiving the sensor signal, the control system (e.g., control system 102) controls motor 530 to drive rotation of collection tray 520 to the original first position (shown in FIG. 5D).

Figure 6:
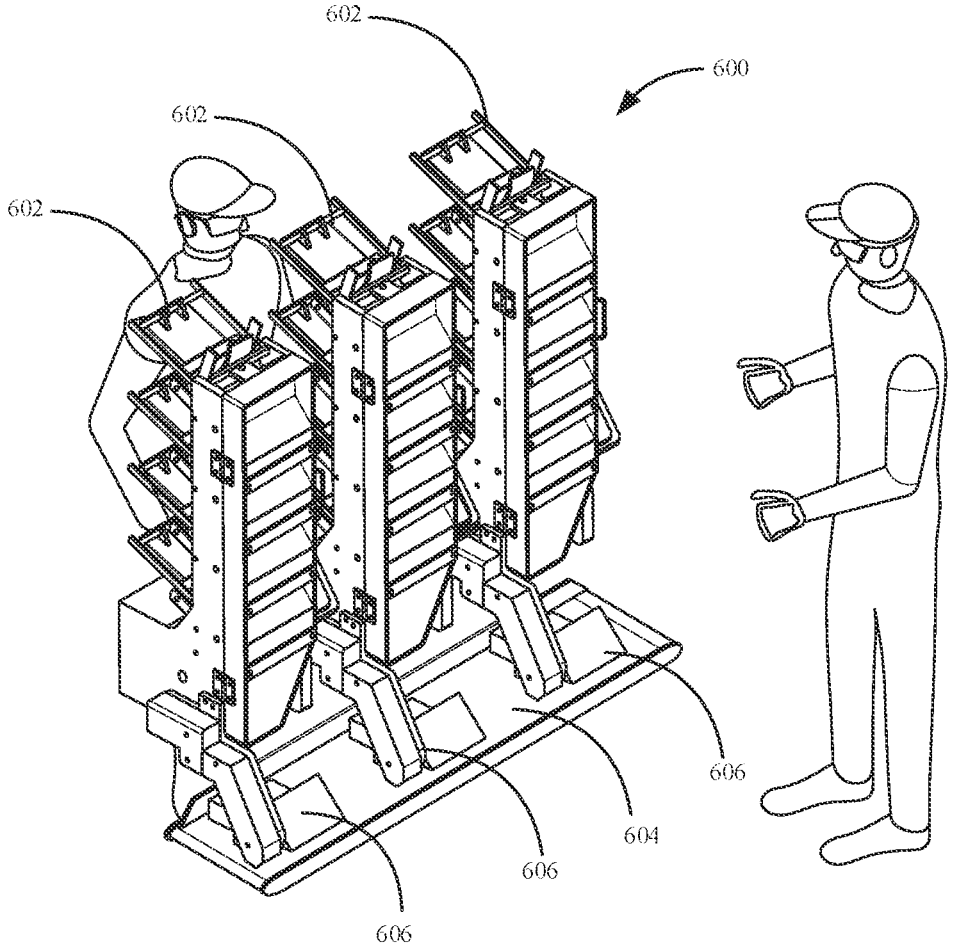
FIG. 6 is a perspective view showing a plurality of collating systems on a conveyor line.

FIG. 6 is a perspective view showing a plurality of collating systems on a conveyor line 600. Conveyor line 600 illustratively includes a plurality of collating systems 602 implemented on a conveyor belt 604. As shown, collection trays 606 are positioned in their respective second positions such that objects collected in collection trays 606 can be released onto conveyor belt 604. By implementing multiple collating systems 602 within a process environment, the collating systems 602 can be coupled together by daisy chaining such that the collating systems can operate in unison for a collating operation. In this way, the number of objects that can be collated and released onto conveyor belt 604 in a single collating operation can increase exponentially relative to the number of collating systems used. Additionally, by fixing multiple collating systems together as in line 600, all collating systems can be operated and/or otherwise controlled from a single display (e.g., display screen 508).

One or more implementations of the technology disclosed or elements thereof can be implemented in the form of a computer product, including a non-transitory computer readable storage medium with computer usable program code for performing the method steps indicated. Furthermore, one or more implementations and clauses of the technology disclosed or elements thereof can be implemented in the form of an apparatus including a memory and at least one processor that is coupled to the memory and operative to perform exemplary method steps. Yet further, in another aspect, one or more implementations and clauses of the technology disclosed or elements thereof can be implemented in the form of means for carrying out one or more of the method steps described herein; the means can include (i) hardware module(s), (ii) software module(s) executing on one or more hardware processors, or (iii) a combination of hardware and software modules; any of (i)-(iii) implement the specific techniques set forth herein, and the software modules are stored in a computer readable storage medium (or multiple such media)

Examples discussed herein include processor(s) and/or server(s). For sake of illustration, but not by limitation, the processors and/or servers include computer processors with associated memory and timing circuitry, and are functional parts of the corresponding systems or devices, and facilitate the functionality of the other components or items in those systems.

Also, user interface displays have been discussed. Examples of user interface displays can take a wide variety of forms with different user actuatable input mechanisms. For instance, a user input mechanism can include icons, links, menus, text boxes, check boxes, etc., and can be actuated in a wide variety of different ways. Examples of input devices for actuating the input mechanisms include, but are not limited to, hardware devices (e.g., point and click devices, hardware buttons, switches, a joystick or keyboard, thumb switches or thumb pads, etc.) and virtual devices (e.g., virtual keyboards or other virtual actuators). For instance, a user actuatable input mechanism can be actuated using a touch gesture on a touch sensitive screen. In another example, a user actuatable input mechanism can be actuated using a speech command.

The present figures show a number of blocks with corresponding functionality described herein. It is noted that fewer blocks can be used, such that functionality is performed by fewer components. Also, more blocks can be used with the functionality distributed among more components. Further, the data stores discussed herein can be broken into multiple data stores. All of the data stores can be local to the systems accessing the data stores, all of the data stores can be remote, or some data stores can be local while others can be remote.

The above discussion has described a variety of different systems, components, logic, and/or interactions. One or more of these systems, components, logic and/or interactions can be implemented by hardware, such as processors, memory, or other processing components. Some particular examples include, but are not limited to, artificial intelligence components, such as neural networks, that perform the functions associated with those systems, components, logic, and/or interactions. In addition, the systems, components, logic and/or interactions can be implemented by software that is loaded into a memory and is executed by a processor, server, or other computing component, as described below. The systems, components, logic and/or interactions can also be implemented by different combinations of hardware, software, firmware, etc., some examples of which are described below. These are some examples of different structures that can be used to implement any or all of the systems, components, logic, and/or interactions described above.

The elements of the described figures, or portions of the elements, can be disposed on a wide variety of different devices. Some of those devices include servers, desktop computers, laptop computers, tablet computers, or other mobile devices, such as palm top computers, cell phones, smart phones, multimedia players, personal digital assistants, etc.

Figure 7:
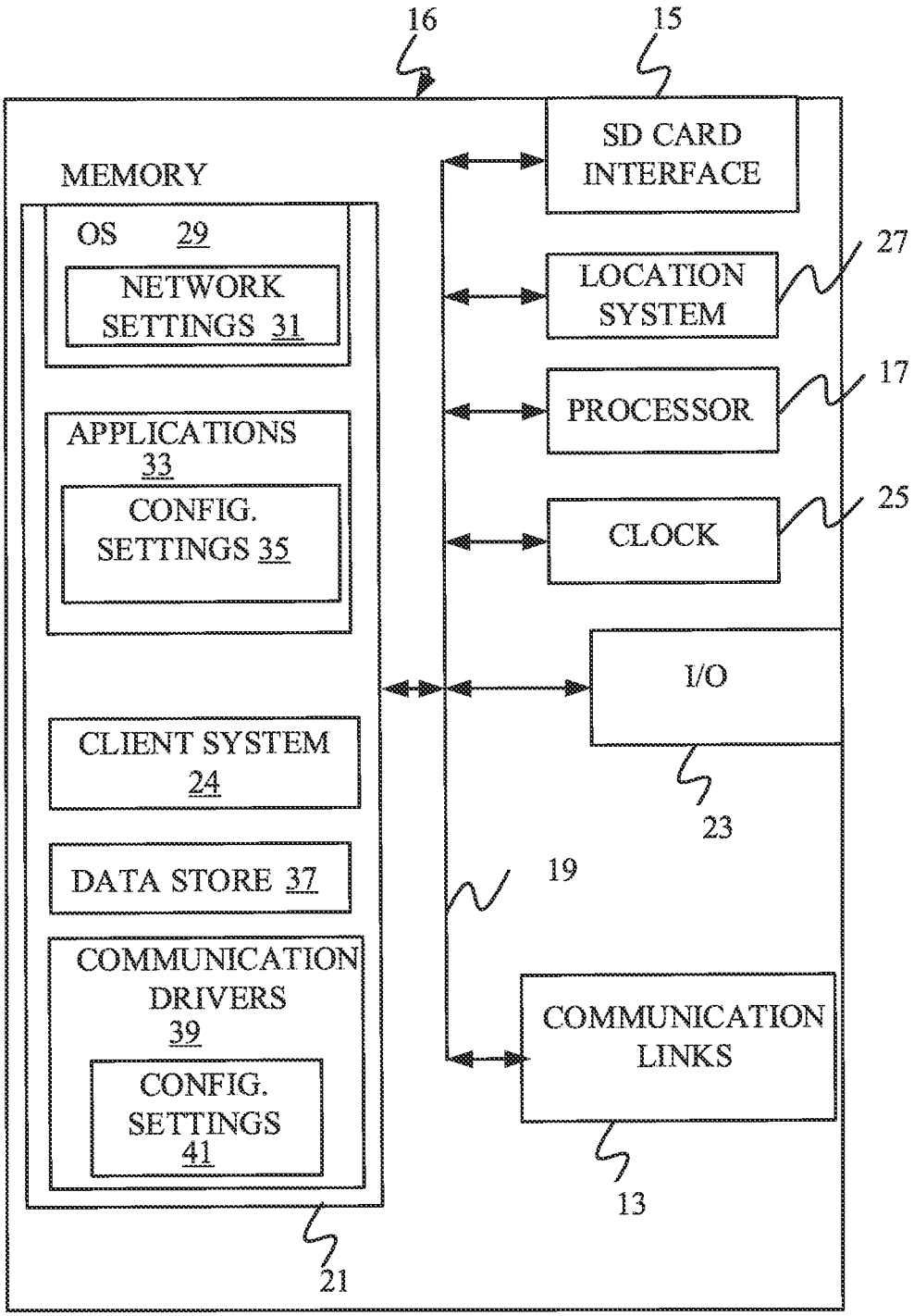
FIG. 7 is a block diagram showing one example of a mobile computing device.

FIG. 7 is a simplified block diagram of one illustrative example of a computing device 16 in which the present system (or parts of it) can be controlled. For example, computing device 16 can control display screen 408 and/or 508 to display a user interface. FIG. 7 is an example of a handheld or mobile device that can be wirelessly connected with collating system 100.

FIG. 7 provides a general block diagram of the components of a client device 16 that can run components of collating system 100. In the device 16, a communications link 13 is provided that allows the handheld device to communicate with other computing devices and under some embodiments provides a channel for receiving information automatically, such as by scanning. Examples of communications link 13 include an infrared port, a serial/USB port, a cable network port such as an Ethernet port, and a wireless network port allowing communication though one or more communication protocols including General Packet Radio Service (GPRS), LTE, HSPA, HSPA+ and other 3G and 4G radio protocols, 1Xrtt, and Short Message Service, which are wireless services used to provide cellular access to a network, as well as Wi-Fi protocols, and Bluetooth protocol, which provide local wireless connections to networks.

In other examples, applications or systems are received on a removable Secure Digital (SD) card that is connected to a SD card interface 15. SD card interface 15 and communication links 13 communicate with a processor 17 (which can also embody processors or servers from other FIGS.) along a bus 19 that is also connected to memory 21 and input/output (I/O) components 23, as well as clock 25 and location system 27.

I/O components 23, in one embodiment, are provided to facilitate input and output operations. I/O components 23 for various embodiments of the device 16 can include input components such as buttons, touch sensors, multi-touch sensors, optical or video sensors, voice sensors, touch screens, proximity sensors, microphones, tilt sensors, and gravity switches and output components such as a display device, a speaker, and or a printer port. Other I/O components 23 can be used as well.

Clock 25 illustratively comprises a real time clock component that outputs a time and date. It can also, illustratively, provide timing functions for processor 17.

Location system 27 illustratively includes a component that outputs a current geographical location of device 16. This can include, for instance, a global positioning system (GPS) receiver, a LORAN system, a dead reckoning system, a cellular triangulation system, or other positioning system. It can also include, for example, mapping software or navigation software that generates desired maps, navigation routes and other geographic functions.

Memory 21 stores operating system 29, network settings 31, applications 33, application configuration settings 35, data store 37, communication drivers 39, and communication configuration settings 41. Memory 21 can include all types of tangible volatile and non-volatile computer-readable memory devices. It can also include computer storage media (described below). Memory 21 stores computer readable instructions that, when executed by processor 17, cause the processor to perform computer-implemented steps or functions according to the instructions. Processor 17 can be activated by other components to facilitate their functionality as well.

Examples of the network settings 31 include things such as proxy information, internet connection information, and mappings. Application configuration settings 35 include settings that tailor the application for a specific enterprise or user. Communication configuration settings 41 provide parameters for communicating with other computers and include items such as GPRS parameters, SMS parameters, connection user names and passwords.

Applications 33 can be applications that have previously been stored on the device 16 or applications that are installed during use, although these can be part of operating system 29, or hosted external to device 16, as well.

Figure 8:
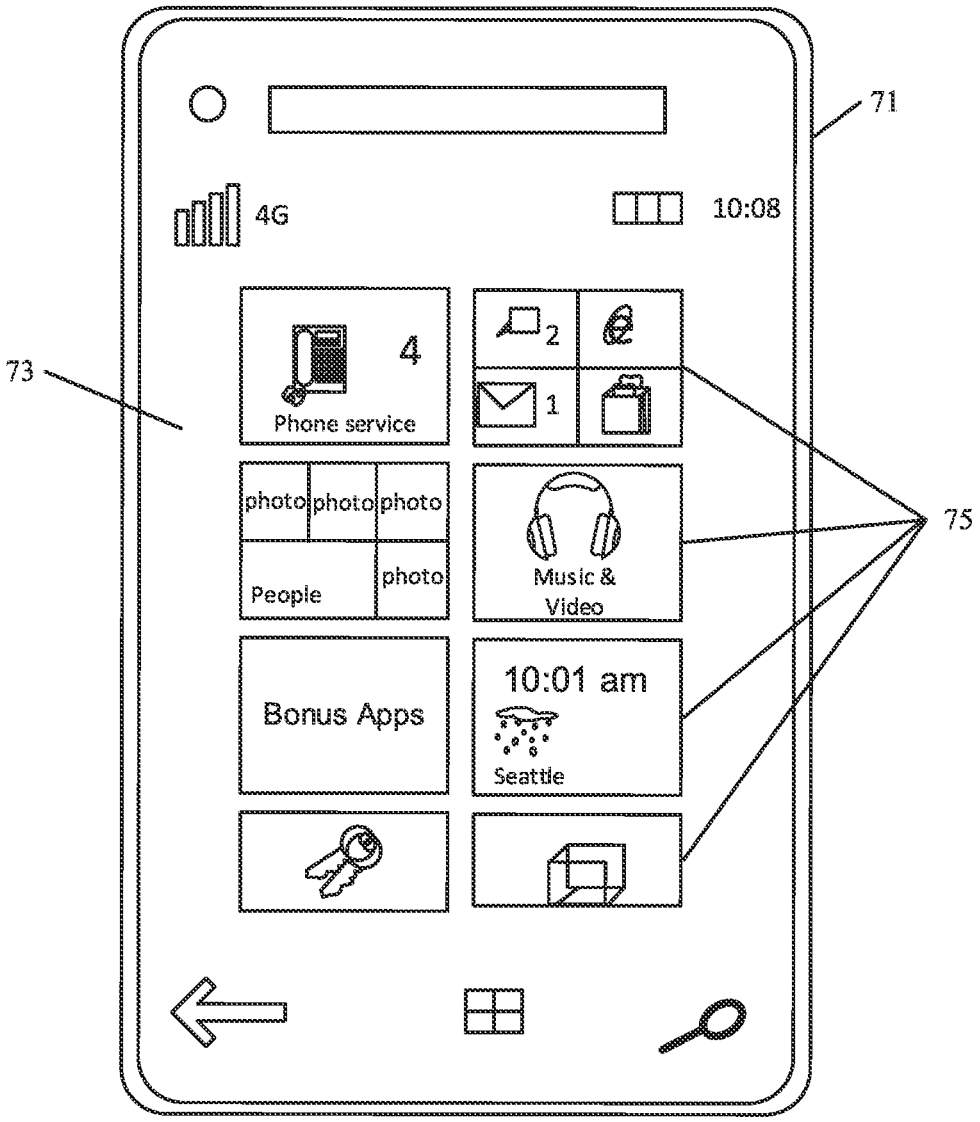
FIG. 8 is a block diagram showing one example of a mobile computing device.

FIG. 8 shows that the device can be a smart phone 71. Smart phone 71 has a touch sensitive display 73 that displays icons or tiles or other user input mechanisms 75. Mechanisms 75 can be used by a user to run applications, make calls, perform data transfer operations, etc. In general, smart phone 71 is built on a mobile operating system and offers more advanced computing capability and connectivity than a feature phone.

Note that other forms of the devices 16 are possible.

Figure 9:
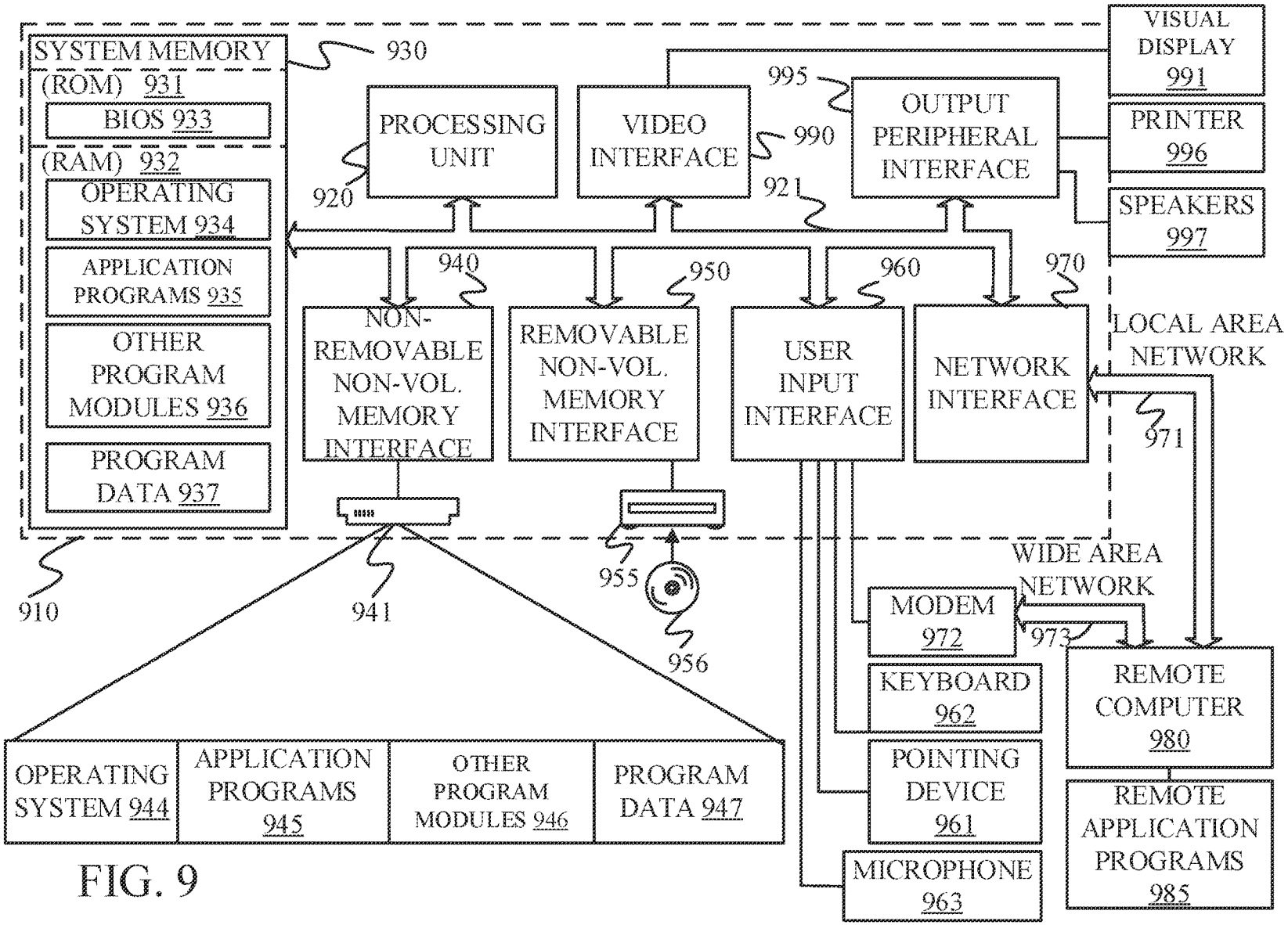
FIG. 9 is a block diagram of one example of a computing environment.

FIG. 9 is one example of a computing environment in which a controller for system 100, or parts of it, (for example) can be deployed. With reference to FIG. 9, an example system for implementing some embodiments includes a general-purpose computing device in the form of a computer 910. Components of computer 910 may include, but are not limited to, a processing unit 920 (which can comprise processors or servers from previous FIGS.), a system memory 930, and a system bus 921 that couples various system components including the system memory to the processing unit 920. The system bus 921 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 910 typically includes a variety of computer readable media. Computer readable media can be any available media that can be accessed by computer 910 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 910. Communication media typically embodies computer readable instructions, data structures, program modules or other data in a transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 930 includes computer storage media in the form of volatile and/or nonvolatile memory such as read only memory (ROM) 931 and random access memory (RAM) 932. A basic input/output system 933 (BIOS), containing the basic routines that help to transfer information between elements within computer 910, such as during start-up, is typically stored in ROM 931. RAM 932 typically contains data and/or program modules that are immediately accessible to and/or presently being operated on by processing unit 920. By way of example, and not limitation, FIG. 9 illustrates operating system 934, application programs 935, other program modules 936, and program data 937.

The computer 910 may also include other removable/non-removable volatile/nonvolatile computer storage media. By way of example only, FIG. 9 illustrates a hard disk drive 941 that reads from or writes to non-removable, nonvolatile magnetic media, and an optical disk drive 955 that reads from or writes to a removable, nonvolatile optical disk 956 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 941 is typically connected to the system bus 921 through a non-removable memory interface such as interface 940, and optical disk drive 955 are typically connected to the system bus 921 by a removable memory interface, such as interface 950.

The drives and their associated computer storage media discussed above and illustrated in FIG. 9, provide storage of computer readable instructions, data structures, program modules and other data for the computer 910. In FIG. 9, for example, hard disk drive 941 is illustrated as storing operating system 944, application programs 945, other program modules 946, and program data 947. Note that these components can either be the same as or different from operating system 834, application programs 935, other program modules 936, and program data 937. Operating system 944, application programs 945, other program modules 946, and program data 947 are given different numbers here to illustrate that, at a minimum, they are different copies.

A user may enter commands and information into the computer 910 through input devices such as a keyboard 962, a microphone 963, and a pointing device 961, such as a mouse, trackball or touch pad. Other input devices (not shown) may include a joystick, game pad, satellite dish, scanner, or the like. These and other input devices are often connected to the processing unit 920 through a user input interface 960 that is coupled to the system bus, but may be connected by other interface and bus structures, such as a parallel port, game port or a universal serial bus (USB). A visual display 991 or other type of display device is also connected to the system bus 921 via an interface, such as a video interface 990. In addition to the monitor, computers may also include other peripheral output devices such as speakers 997 and printer 996, which may be connected through an output peripheral interface 995.

The computer 910 is operated in a networked environment using logical connections to one or more remote computers, such as a remote computer 980. The remote computer 980 may be a personal computer, a hand-held device, a server, a router, a network PC, a peer device or other common network node, and typically includes many or all of the elements described above relative to the computer 910. The logical connections depicted in FIG. 9 include a local area network (LAN) 971 and a wide area network (WAN) 973, but may also include other networks. Such networking environments are commonplace in offices, enterprise-wide computer networks, intranets and the Internet.

It should also be noted that the different embodiments described herein can be combined in different ways. That is, parts of one or more embodiments can be combined with parts of one or more other embodiments. All of this is contemplated herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A vertical collating system, comprising:

a plurality of channels, each channel, of the plurality of channels, having one or more channel walls;

a plurality of feeders configured to hold a plurality of objects, each feeder, of the plurality of feeders, corresponding to a respective channel, of the plurality of channels, and configured to dispense one or more objects of the plurality of objects into the respective channel, wherein the respective channel has a material that engages an object of plurality of objects as the object is dispensed through the respective channel, and a first coefficient of friction between the object and the material is different than a second coefficient of the friction between the object and the one or more channel walls of the respective channel; and an accumulation area configured to receive each dispensed object from each respective channel to form a set of collated objects.

2. The vertical collating system of claim 1, further comprising a plurality of channel adjustment mechanisms, each channel adjustment mechanism being coupled to a particular channel, of the plurality of channels, and configured to adjust a width of the particular channel.

3. The vertical collating system of claim 2, wherein each channel adjustment mechanism comprises at least one adjustment knob configured to rotate in a first direction to increase the width of the particular channel.

4. The vertical collating system of claim 3, wherein the at least one adjustment knob is configured to rotate in a second direction to decrease the width of the particular channel.

5. The vertical collating system of claim 1, further comprising a plurality of guide strips, each guide strip being configured to removably couple to one of the plurality of channels and extend the material therethrough.

6. The vertical collating system of claim 5, wherein the plurality of guide strips are removably couplable to the plurality of channels by one or more threaded fasteners.

7. The vertical collating system of claim 1, wherein the accumulation area further comprises a collection tray having a plurality of height adjustment mechanisms, each height adjustment mechanism being configured to adjust a height at which each dispensed object from each respective channel is received.

8. The vertical collating system of claim 1, wherein each of the plurality of feeders is coupled to a respective channel by a coupling mechanism.

9. The vertical collating system of claim 8, wherein each of the plurality of feeders is configured such that each feeder is removable from the respective channel by decoupling the coupling mechanism.

10. A vertical collating system comprising:

a channel having a pair of channel walls;

a feeder configured to hold a plurality of objects and to dispense an object, from the plurality of objects, into the channel;

a friction adjustment system configurable to adjust a frictional force that resists movement of the object through the channel, the friction adjustment system comprising one or more channel adjustment mechanisms operably coupled to at least one channel wall, of the pair of channel walls, and configured to adjust a width between the pair of channel walls; and an accumulation area downstream of the channel and configured to receive the object.

11. The vertical collating system of claim 10, further comprising:

a guide strip removably disposed on the at least one channel wall.

12. The vertical collating system of claim 11, wherein a first coefficient of friction between the object and the guide strip is lower than a second coefficient of friction between the object and the channel walls.

* * * * *